US006892498B1

(12) United States Patent
Roman

(10) Patent No.: US 6,892,498 B1
(45) Date of Patent: May 17, 2005

(54) INTERLOCKING CONSTRUCTION SYSTEM

(76) Inventor: James D. Roman, Oregonized Builders 1601 Stover La., Myrtle Point, OR (US) 97458

( * ) Notice: Subject to any disclaimer, the term of this patent is extended or adjusted under 35 U.S.C. 154(b) by 40 days.

(21) Appl. No.: 10/310,085

(22) Filed: Dec. 4, 2002

Related U.S. Application Data

(60) Provisional application No. 60/344,908, filed on Dec. 31, 2001, provisional application No. 60/336,021, filed on Dec. 5, 2001.

(51) Int. Cl.[7] ..... E04B 1/00; E04B 1/38; E02D 27/00

(52) U.S. Cl. ..... 52/79.5; 52/79.4; 52/592.1; 52/284; 52/282.2; 52/282.3; 52/262; 52/264

(58) Field of Search ..... 52/79.5, 79.4, 52/586.1, 264, 262, 592.1, 270, 284, 282.2, 52/282.3, 592.5, 592.6

(56) References Cited

U.S. PATENT DOCUMENTS

| | | | | |
|---|---|---|---|---|
| 2,732,706 A | * | 1/1956 | Friedman | 52/586.1 |
| 4,698,947 A | * | 10/1987 | McKay | 52/309.12 |
| 5,134,826 A | * | 8/1992 | La Roche et al. | 52/584.1 |
| 5,490,357 A | * | 2/1996 | Lin | 52/220.7 |
| 5,860,260 A | | 1/1999 | Hase | |
| 5,887,401 A | | 3/1999 | Moore, Jr. | |
| 5,950,396 A | | 9/1999 | Fosdick, Jr. | |
| 6,006,480 A | | 12/1999 | Rook | |
| 6,112,473 A | | 9/2000 | Pingel | |
| 6,173,547 B1 | | 1/2001 | Lipson | |
| 6,185,898 B1 | | 2/2001 | Pratt | |
| 6,233,892 B1 | | 5/2001 | Tylman | |
| 6,237,297 B1 | | 5/2001 | Paroly | |
| 6,305,142 B1 | | 10/2001 | Brisson et al. | |

(Continued)

OTHER PUBLICATIONS

"Oregonized Builders' ICS: An Intriguing Interlocking Panel System", Automated Builder, Sep. 1998 p. 38.
"ICS inventor receives research grant", Myrtle Point Herald, May 25, 2000.

(Continued)

*Primary Examiner*—Peter M. Cuomo
*Assistant Examiner*—Sarah C. Burnham
(74) *Attorney, Agent, or Firm*—David S. Alavi

(57) ABSTRACT

Each panel of an interlocking construction system comprises: first and second sheathing members; at least one framing member secured between the sheathing members; a male and/or female panel side edge. The male panel side edge includes splines, each extending from between the sheathing members distally beyond the side edges, substantially perpendicular thereto. The female panel side edge includes a opposing pairs of parallel grooves, one on each sheathing member and extending proximally from the second side edge substantially perpendicular thereto. The female panel edge may engage a male panel edge of another similarly adapted panel with the splines of the other panel received within the grooves of the female panel edge. The male panel edge is adapted for engaging a female panel edge of another similarly adapted panel with the splines of the male panel edge inserted into grooves of the other panel.

56 Claims, 13 Drawing Sheets

U.S. PATENT DOCUMENTS

| | | | | |
|---|---|---|---|---|
| 6,321,496 | B1 * | 11/2001 | Martin, Jr. | 52/364 |
| 6,393,782 | B1 * | 5/2002 | Berridge et al. | 52/239 |
| 6,401,419 | B1 * | 6/2002 | Beliveau | 52/592.6 |
| 6,571,523 | B2 * | 6/2003 | Chambers | 52/309.2 |
| 6,647,686 | B2 * | 11/2003 | Dunn et al. | 52/426 |
| 2001/0029712 | A1 * | 10/2001 | Emaus et al. | 52/239 |
| 2002/0043038 | A1 * | 4/2002 | Cerrato | 52/604 |

OTHER PUBLICATIONS

Stephanie Basaglia, "Carpenter locks sight on new era in home design", The Daily Journal of Commerce, Jul. 11, 2000 pp. 5 and 31.

* cited by examiner

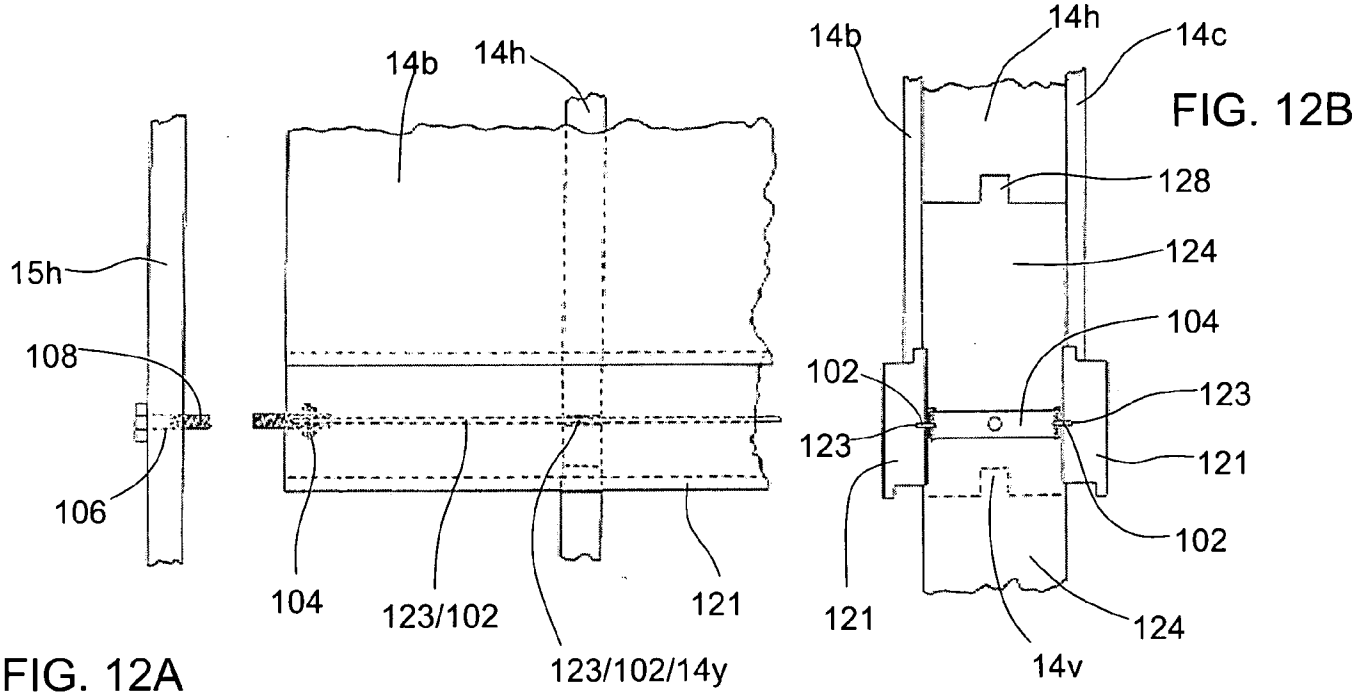
FIG. 12B
FIG. 12A
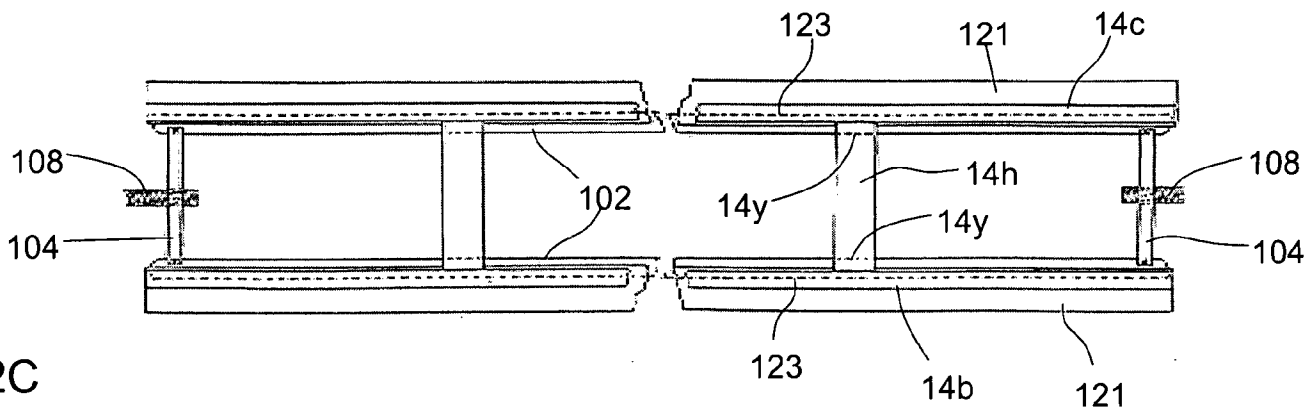
FIG. 12C

INTERLOCKING CONSTRUCTION SYSTEM

RELATED APPLICATIONS

This application claims benefit of prior-filed provisional App. No. 60/336,021 entitled "Interlocking construction system" filed Dec. 5, 2001 now abandoned in the name of James D. Roman, said provisional application being hereby incorporated by reference as if fully set forth herein. This application claims benefit of prior-filed provisional App. No. 60/344,908 entitled "Interlocking construction system" filed Dec. 31, 2001 now abandoned in the name of James D. Roman, said provisional application being hereby incorporated by reference as if fully set forth herein.

STATEMENT REGARDING FEDERALLY SPONSORED RESEARCH

The U.S. Government has a paid-up license in this invention and the right in limited circumstances to require the patent owner to license others on reasonable terms as provided for by the terms of Contract Nos. 00-33610-8895 and 2001-03295 awarded by the United States Department of Agriculture.

BACKGROUND

The field of the present invention relates to building construction. In particular, a system of interlocking panels for constructing a building are disclosed herein.

A wide variety of panels are available for constructing buildings. Some of these are described in:

U.S. Pat. No. 5,860,260 entitled "Block member and panel structure" issued Jan. 19, 1999 to Hase;

U.S. Pat. No. 5,887,401 entitled "Concrete form system" issued Mar. 30, 1999 to Moore, Jr.;

U.S. Pat. No. 5,950,396 entitled "Method and apparatus for producing and erecting precast concrete walls using sawing" issued Sep. 14, 1999 to Fosdick, Jr.;

U.S. Pat. No. 6,006,480 entitled "Low cost prefabricated housing construction system" issued Dec. 28, 1999 to Rook;

U.S. Pat. No. 6,112,473 entitled "Molded wall panel and house construction" issued Sep. 5, 2000 to Pingel;

U.S. Pat. No. 6,173,547 entitled "Panelized, edge-connected, modified-rhombic triacontahedral structures" issued Jan. 16, 2001 to Lipson;

U.S. Pat. No. 6,185,898 entitled "High strength wall frames and system utilizing same" issued Feb. 13, 2001 to Pratt;

U.S. Pat. No. 6,233,892 entitled "Structural panel system" issued May 22, 2001 to Tylman;

U.S. Pat. No. 6,237,297 entitled "Modular structural members for constructing buildings, and buildings constructed of such members" issued May 29, 2001 to Paroly; and U.S. Pat. No. 6,305,142 entitled "Apparatus and method for installing prefabricated building system for walls roofs and floors using foam core building pane" issued Oct. 23, 2001 to Brisson et al.

As evidenced by the foregoing, many schemes, designs, and/or configurations exist for panelized construction of buildings and/or similar structures. A common drawback of many such panelized constructions stems from inherent mechanical weaknesses in the finished structures, particularly near joints between adjacent panels. Current panelized systems often require heavy equipment and/or specialized tools for assembly at the construction site.

SUMMARY

An interlocking construction system comprises a plurality of interlocking building panels, each of the panels comprising: first and second sheathing members arranged in a spaced-apart arrangement with corresponding side edges and ends aligned; at least one elongated framing member between the sheathing members and secured to each; and at least one of a male panel side edge and a female panel side edge. The framing member is arranged substantially parallel to the side edges of the sheathing members. The male panel side edge includes a plurality of splines, each spline extending proximally between the first and second sheathing members and secured to each, and extending distally from the corresponding first side edges of the sheathing members. The splines are substantially perpendicular to the sheathing member side edges. The female panel side edge includes a plurality of opposing pairs of substantially parallel grooves, one on the inner surface of each sheathing member and extending proximally from the second side edge. The grooves are substantially perpendicular to the second side edge. The female panel edge is adapted for engaging a male panel edge of another similarly adapted building panel with the splines of the other panel received within the grooves of the female panel edge. The male panel edge is adapted for engaging a female panel edge of another similarly adapted building panel with the splines of the male panel edge inserted into grooves of the other panel.

Some panels of the interlocking construction system may have both male and female panel side edges, while others may have only one or the other, with the other panel side edge being otherwise suitably adapted for assembling a structure. The splines of the male panel side edge may be each configured as a single member or as a pair of substantially parallel side members, and the parallel side members may be joined near their distal ends by a center member to form a "U"-shape. The panels may include a framing member running between the pair of parallel side members. The female panel side edge may include sheathing leaf members for retaining the sheathing members of one panel when side-engaged with another panel. The framing members may be adapted for engaging framing members of other panels upon assembly, either in an end-to-end arrangement, a substantially perpendicular arrangement, or at some other angular arrangement. Various additional elements of the interlocking construction system may be used for facilitation end-engagement of panels. Such elements may include means for retaining panels in end-engagement and/or means for retaining panels in side-to-side engagement.

Objects and advantages of the present invention may become apparent upon referring to the disclosed embodiments as illustrated in the drawings and disclosed in the following written description and/or claims.

BRIEF DESCRIPTION OF THE DRAWINGS

FIGS. 12A–12C illustrate details of retaining members and tensioning members of the interlocking construction system.

Figure 1:
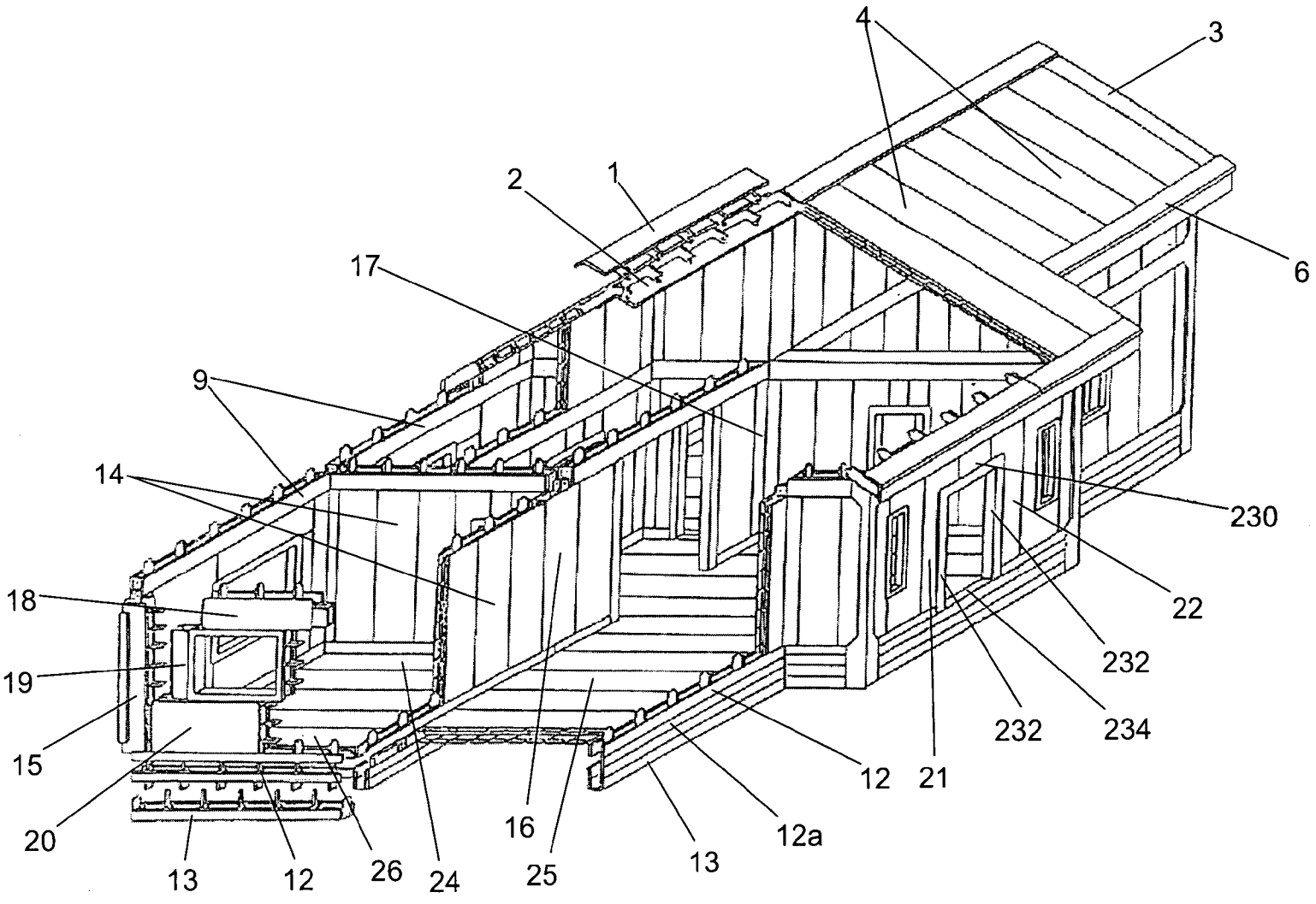
FIG. 1 illustrates a structure partially structured using the interlocking construction system.
Figure 2:
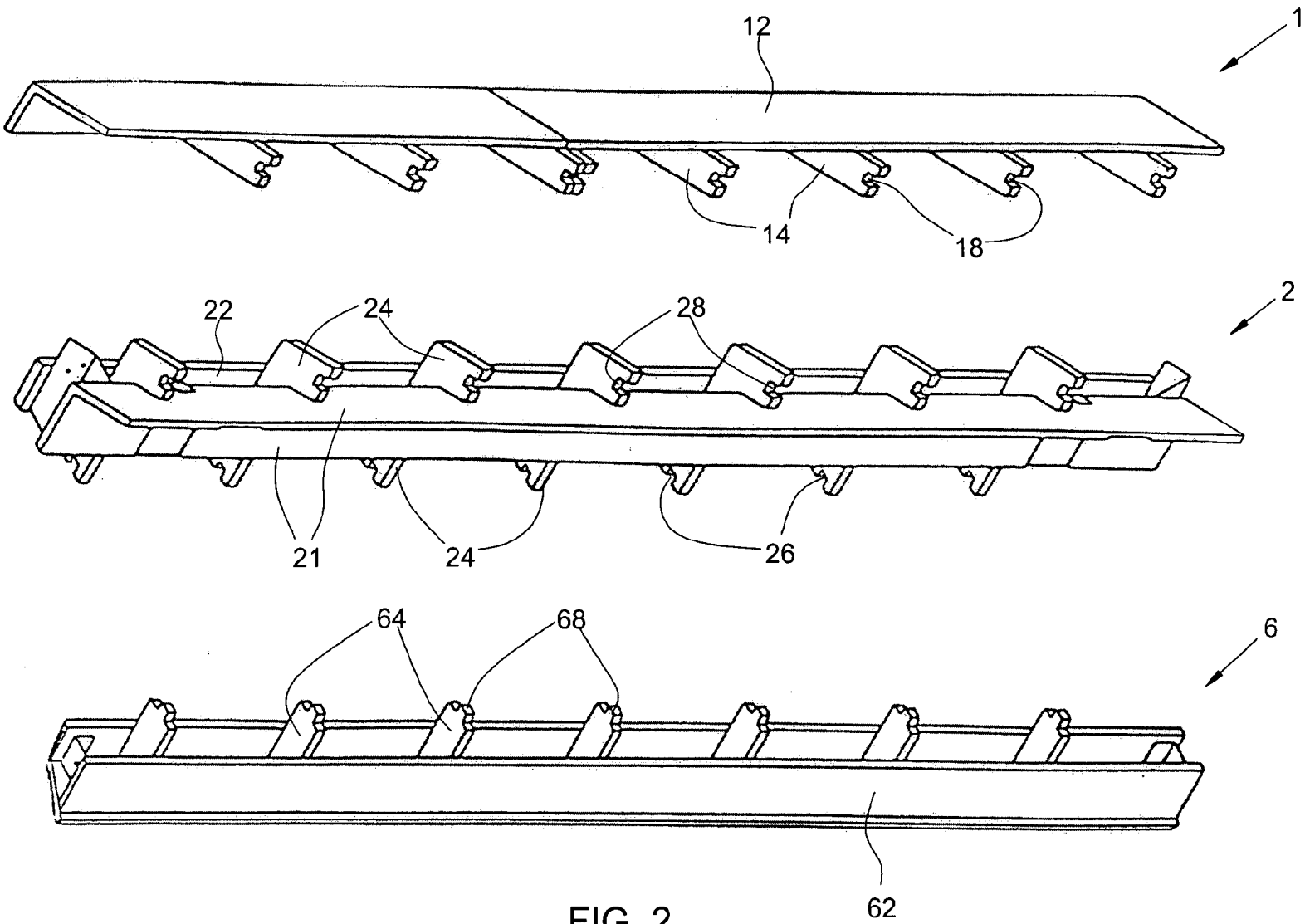
FIG. 2 illustrates a roof cap element, a roof ridge element, and a fascia element of the interlocking construction system.

It should be noted that the alphabetical reference characters used for designating the elements of wall panel 14 may be employed for designating corresponding elements of other panel types in other Figures, i.e., framing member 14*h* of wall panel 14 corresponds to framing member 25*h* (if specifically labeled) of floor panel 25, sheathing member 14*c* of wall panel 14 corresponds to sheathing member 4*c* of roof panel 4, and so forth.

The embodiments shown in the Figures are exemplary, and should not be construed as limiting the scope of the present disclosure and/or appended claims.

DETAILED DESCRIPTION OF EMBODIMENTS

FIG. 1 shows a partially assembled exemplary structure built using a construction system of interlocking building panels. FIGS. 2 through 10 show various individual panels of the system of interlocking building panels, while FIGS. 11A–11D and 12A–12C show details of the interlocking of the panels. The exemplary structure of FIG. 1 is shown partially assembled with roof cap elements 1, roof ridge elements 2, female roof end panels 3, roof panels 4, fascia elements 6, wall header elements 9, floor/wall header elements 12 and access elements 12*a*, sill elements 13, wall panels 14, two-wall corner panels 15, three-wall corner panel 16, four-wall corner panel 17, window header panels 18, window panels 19, window base panels 20, female door panels 21, male door panels 22, doorjamb elements 230 and 232, door threshold elements 234, female floor end panels 24, floor panels 25, male floor end panels 26. While not shown or not visible in FIG. 1, male roof end panels 5, male gable end panels 7, female gable end panels 8, gable center panels 10, and gable side panels 11 may also be employed for completing assembly of the structure of FIG. 1. The structure of FIG. 1 is exemplary only, and myriad other structures may be assembled using the standardized building panels and building elements of the system disclosed and/or claimed herein.

The general structure of building panels of the interlocking construction system may be most readily described by referring to a wall panel 14 as shown in FIG. 7 and FIGS. 11A–11D. Wall panel 14 comprises a pair of sheathing members 14*b* and 14*c*, each having corresponding first side edges 14*d* and 14*e* and corresponding second side edges 14*f* and 14*g*. The sheathing members are arranged in a spaced apart arrangement with the corresponding side edges substantially aligned. An elongated framing member 14*h* is positioned between and secured to each of the sheathing members, and is arranged substantially parallel to the side edges.

A male panel side edge is formed at first side edges 14*d* and 14*e* of the sheathing members 14*b* and 14*c*, the male panel side edge including a plurality of splines 14*i* each extending proximally between sheathing members 14*b* and 14*c*, and extending distally from the side edges 14*d* and 14*e* in a direction substantially perpendicular thereto. A female panel side edge is formed at second side edges 14*f* and 14*g* of sheathing members 14*b* and 14*c*. The female panel side edge includes a plurality of opposing pairs of grooves 14*p*, one groove of each pair being positioned on the inner surface of each of sheathing members 14*b* and 14*c* and extending proximally from edges 14*f* and 14*g* in a direction substantially perpendicular thereto. The male and female panel side edges are adapted for engaging similarly adapted building panels side-to-side, by inserting the splines 14*i* of the male panel side edge of one wall panel (or other panel type) into the grooves of the female panel side edge of a second wall panel (or other panel type).

The splines 14*i* may be each comprise a single member, or may comprise a pair of substantially parallel spline side members 14*j*. If comprising a pair of side members 14*j*, the spline may further include a center member 14*k* joined to the side members 14*j* near their distal ends, thereby forming a "U"-shaped spline 14*i*. The side members 14*j* are each secured in opposing positions to the inner surfaces of the sheathing members 14*b* and 14*c*, extend distally from the side edges 14*d* and 14*e*, and are joined near their distal ends by center member 14*k* (if present). The distal portion of the splines 14*i* may be beveled for facilitating insertion of splines 14*i* into corresponding grooves of another panel, as described hereinabove. A second elongated framing member 14*m* is positioned between the side members 14*j* of the splines 14*i* and secured thereto, the framing member 14*m* being arranged substantially parallel to edges 14*d* and 14*e*. The outer surfaces of spline side members 14*j* may be further provided with a raised central longitudinal portion 14*q* between recessed longitudinal edges 14*r*. Continuation of grooves 14*p* from the female panel side edge to the male panel side edge may receive therein the raised portion 14*q* of the proximal portion of side members 14*j* during manufacture of the building panel, while the longitudinal edges 14*r* rest on the inner surface of the panel, thereby enhancing the structural integrity of the panel. Upon engagement of the splines 14*i* with grooves of another panel, the raised central longitudinal portion 14*q* of the distal portion of side members 14*j* is received within the groove of the other panel, while the recessed longitudinal edges 14*r* rest against the inner surface of the corresponding sheathing member of the other panel. Thus are perpendicular loads distributed on the sheathing members of the other panel somewhat away from the grooves thereof.

The female panel side edge may be further provided with a plurality of elongated sheathing leaf members 14*s* secured to the inner surfaces of the sheathing members at edges 14*f* and 14*g* and arranged substantially parallel thereto. The sheathing leaf members extend distally beyond the side edges 14*f* and 14*g* and are inserted between the sheathing member side edges of the male panel side edge of another building panel upon engagement thereof with the female side panel edge. The distal portions of the sheathing leaf members 14*s* may be beveled for facilitating insertion thereof between the sheathing members of the other panel engaged therewith. The sheathing member side edges 14*f* and 14*g* are thereby retained by sheathing member side edges of the other engaged panel.

The adaptations of the splines 14*i* (extending across joints between engaged panels), grooves 14*p* (receiving splines 14*i*), sheathing leaf members 14*s* (retaining sheathing members of another engaged panel), and so forth together serve to distribute the load path onto extended portions of the skin (i.e., sheathing) of a structure built using the system of interlocking panels. Structures constructed using the system of interlocking building panels are therefore better able than their conventionally-constructed counterparts to withstand external forces (wind, earthquakes, impacts, and so forth) without substantial structural failure.

Wall panels 14 (FIG. 7), floor panels 25 (FIG. 10), and roof panels 4 (FIG. 3) are each provided with both male and female panel side edges, and are thereby adapted for side-to-side engagement of multiple panels in a row. Two or more panels may be thus engaged for constructing as long a wall, floor, or roof segment as needed for a particular structure. In the case of a wall constructed from multiple panels 14, the panels may be made as tall as desired for providing a wall of a desired height with a single row of side-to-side-engaged wall panels 14, as shown in FIG. 1. Alternatively, additional rows of wall panels may be assembled on top of and engaged with a first row of wall panels to assemble higher walls (not shown). Single rows of side-to-side-engaged roof panels 4 or floor panels 25 may be employed for constructing roofs or floors, respectively, of any desired length. Floor and roof panels may be manufactured so as to be sufficiently long to span the desired width of the floor or roof area to be covered. In any of these cases, the interlocking mechanism described hereinabove yields a near unitary structure in which loads, stresses, and weaknesses are distributed substantially throughout the wall or floor or roof through the sheathing members, splines, and framing members.

Two-wall, three-wall, and four-wall corner panels 15, 16, and 17 (FIG. 7) are also each provided with both male and female panel side edges. For a two-wall corner panel, the sheathing members 15*b* and 15*c* each comprise two substantially perpendicular segments (with the sheathing member corresponding to the inside corner having suitably reduced dimensions so that the corresponding side edges are aligned), but otherwise the male and female panel side edges, including splines, grooves, sheathing leaf members, framing members, and so forth are substantially similar to those described hereinabove for wall panel 14. For three-wall corner segment 16, three suitably configured sheathing members are required, and a second male or female panel side edge is formed for engaging a third wall. Similarly, four sheathing members are required for forming a four-wall corner panel 17, with a second and third male or female side edges formed for engaging third and fourth walls. While the wall corner members are described for joining substantially perpendicular walls, corner panels 15/16/17 may be suitably adapted for providing other desired wall angles.

Figure 3:
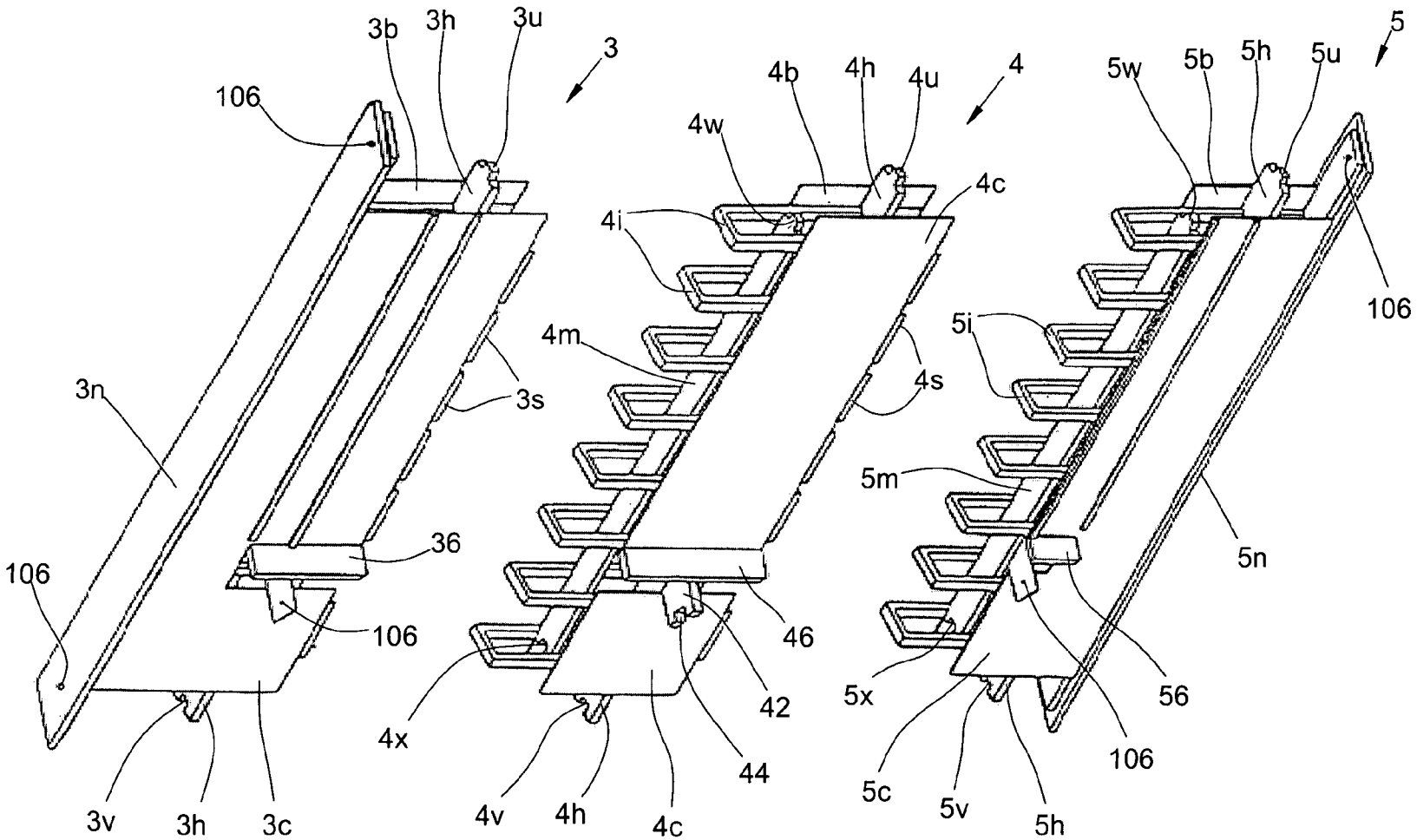
FIG. 3 illustrates a female roof end panel, a roof panel, and a male roof end panel of the interlocking construction system.
Figure 4:
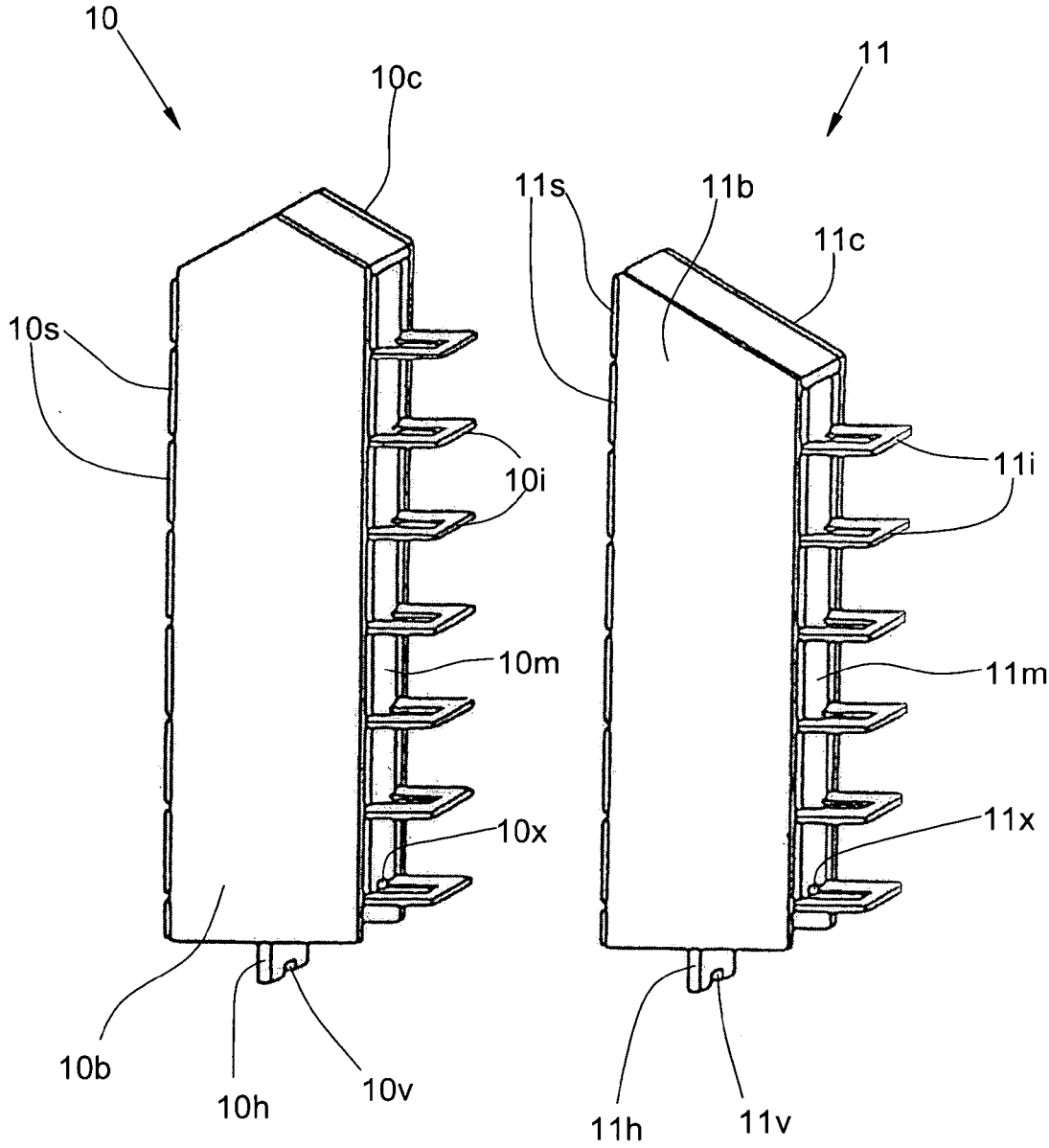
FIG. 4 illustrates a center gable panel and a side gable panel of the interlocking construction system.
Figure 5:
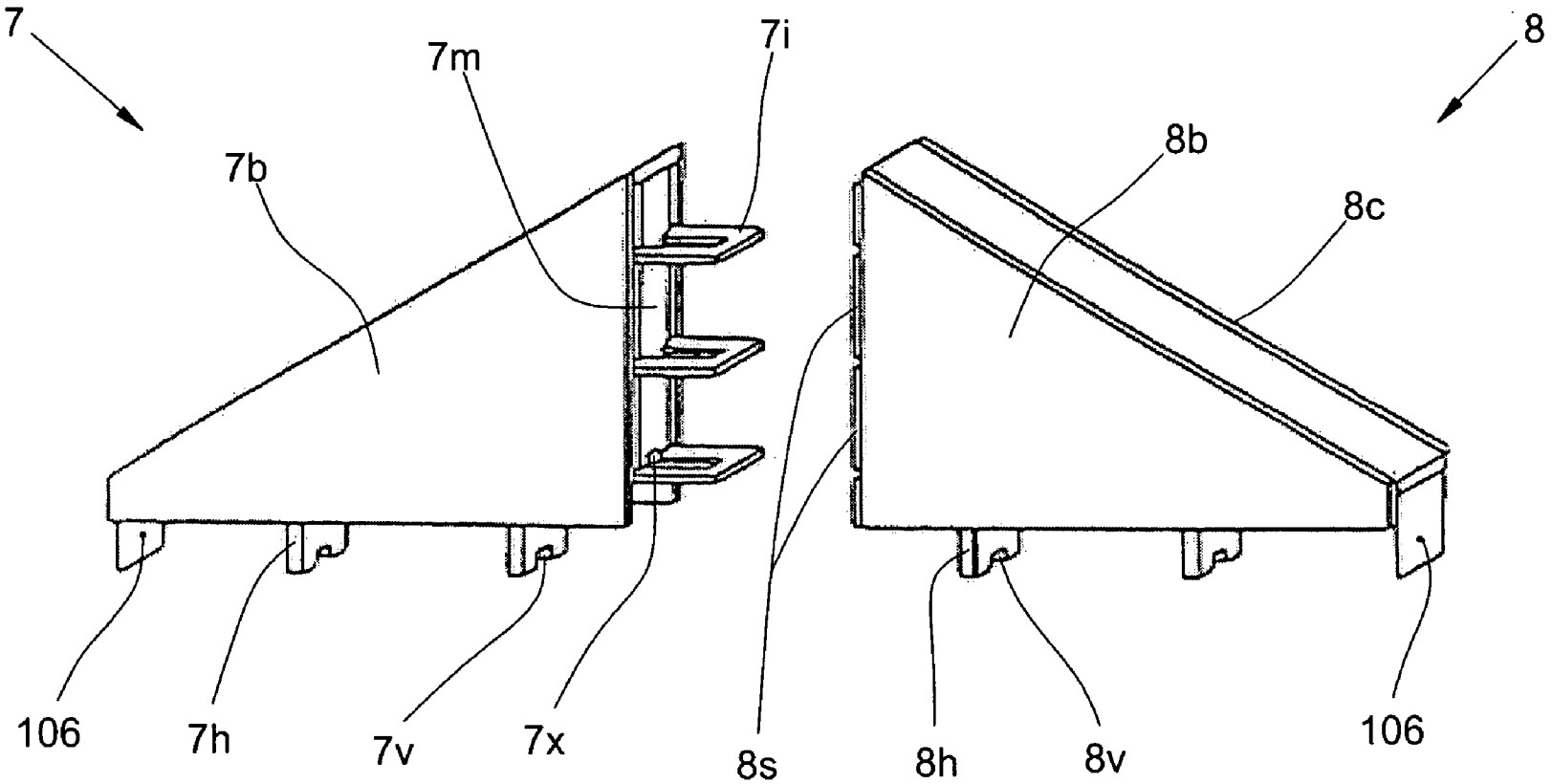
FIG. 5 illustrates end gable panels of the interlocking construction system.

In addition to panels having both male and female panel side edges, the interlocking construction system also includes end panels having either one male panel side edge or one female panel side edge, but not both. The other panel side edge is adapted in some other suitable way for assembling the structure. The other panel side edge may be provided with a finished appearance, as shown in roof end panels 3 and 5 with finished panel side edges 3*n* and 5*n* (FIG. 3). A wall panel may be similarly provided with one finished panel side edge (not shown) for constructing a wall that simply ends (without forming a corner with another wall). Floor end panels 24 and 26 (FIG. 10) each have one male or female panel side edge, with the other panel side edge having side joist members 24*t* and 26*t*, respectively, protruding from between the sheathing members for supporting the edge of the floor (described further hereinbelow).

Figure 9:
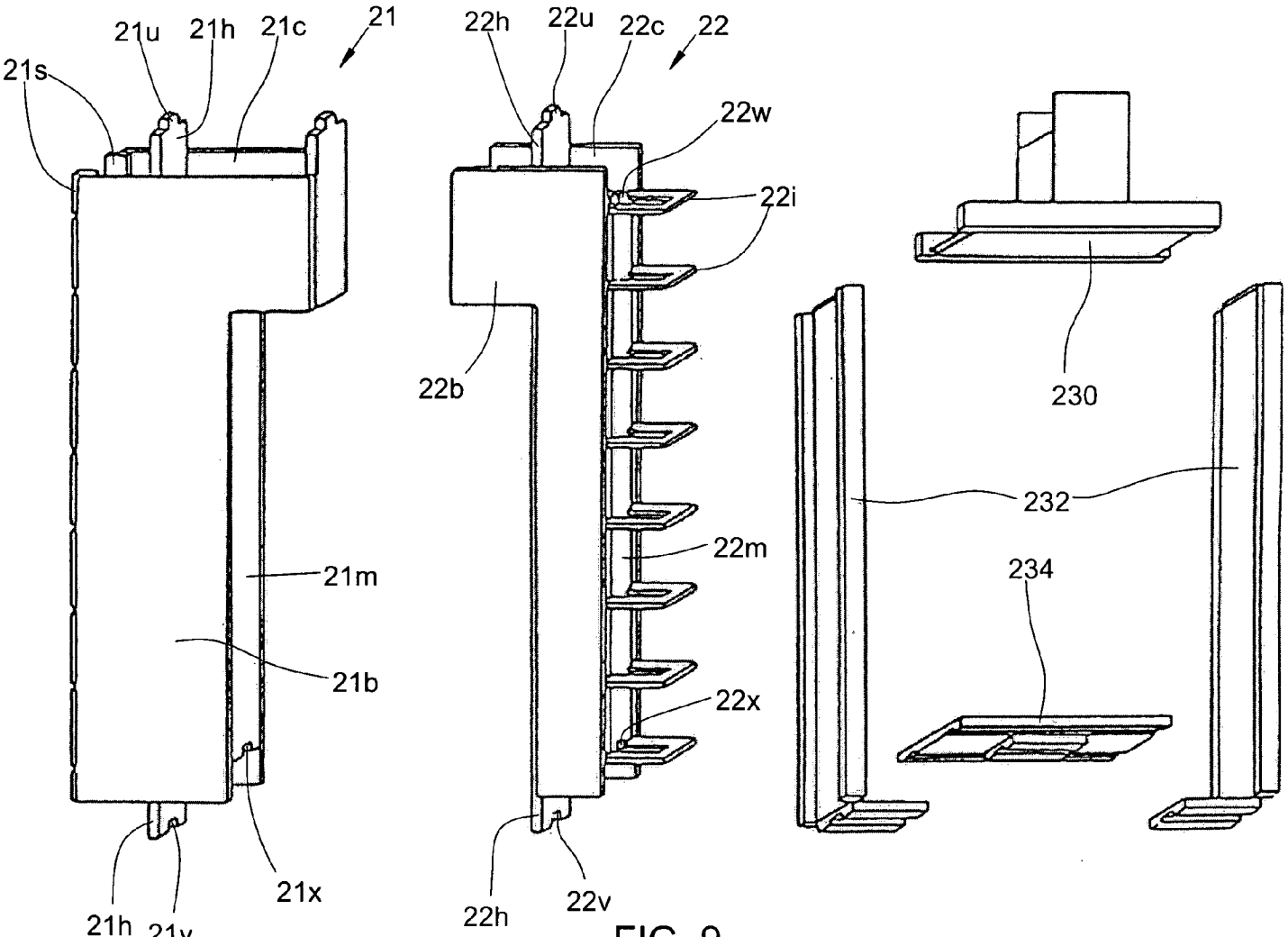
FIG. 9 illustrates a female door panel, a male door panel, and door jamb/threshold elements of the interlocking construction system.
Figure 10:
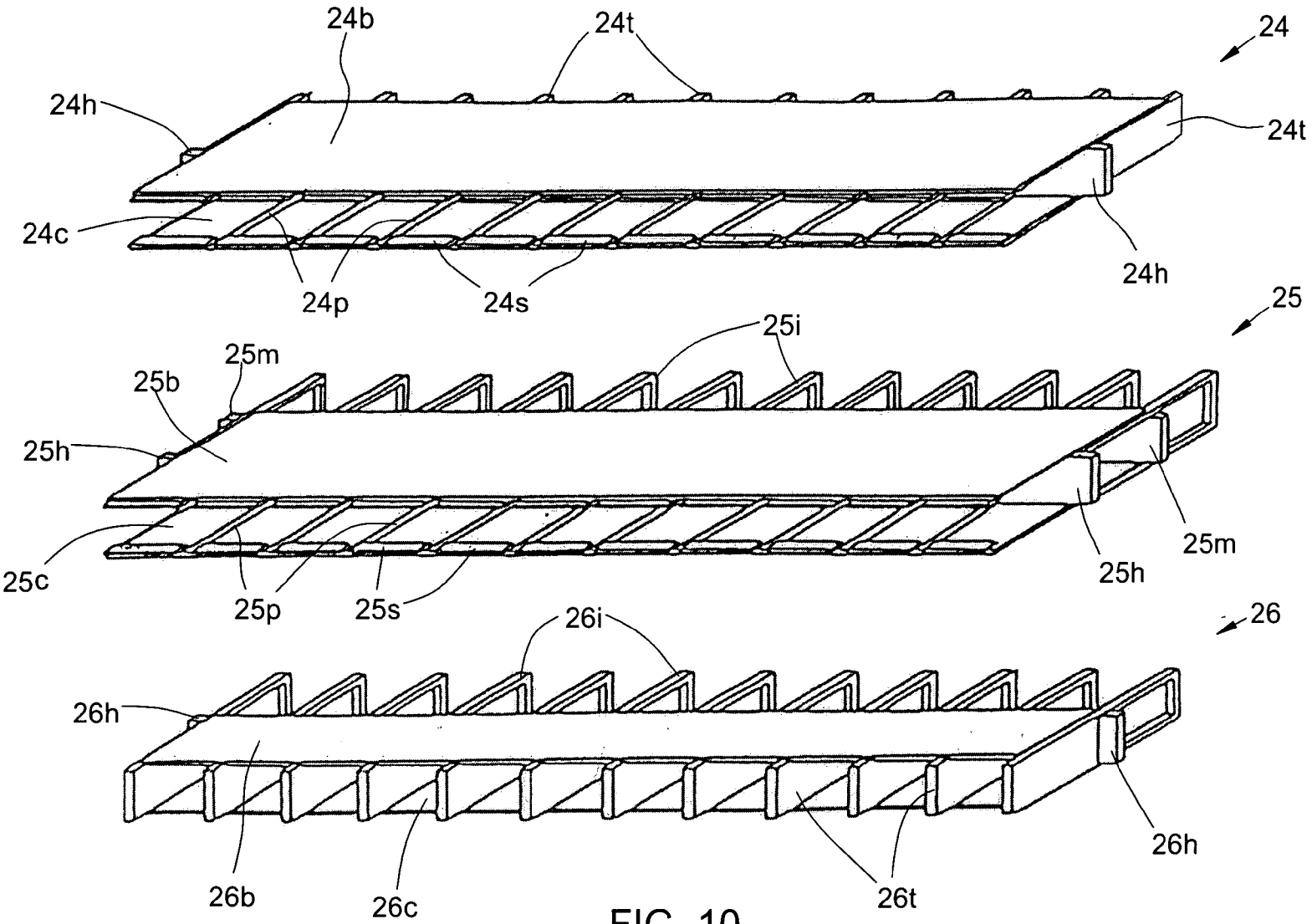
FIG. 10 illustrates a female floor end panel, a floor panel, and a male floor end panel of the interlocking construction system.
Figure 11A:
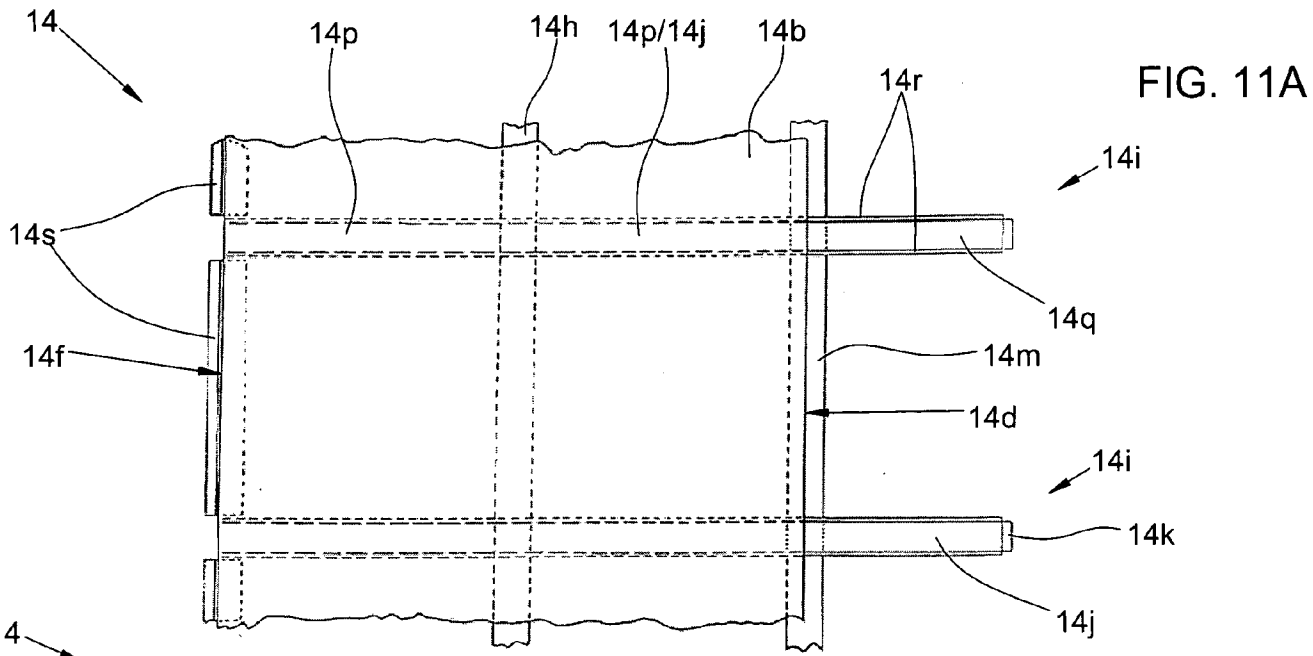
FIGS. 11A–11D illustrate details of splines and grooves for side-engaging panels of the interlocking construction system.
Figure 11B:
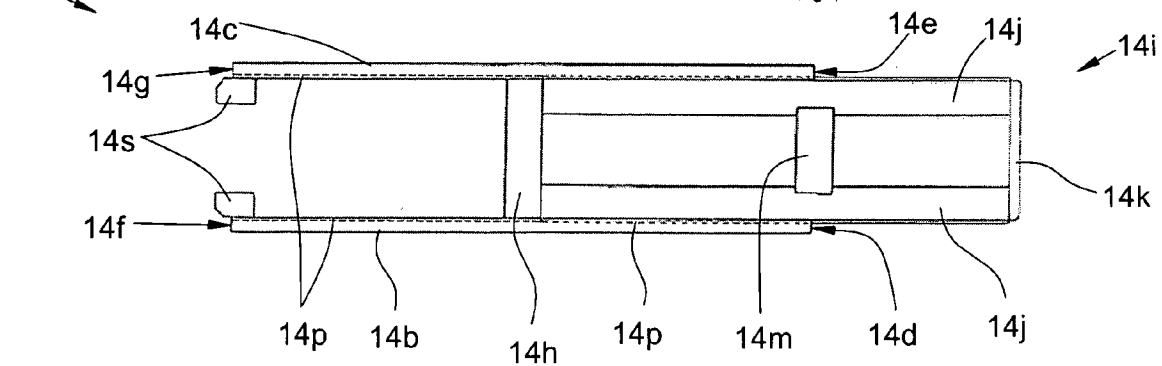
Figure 11D:
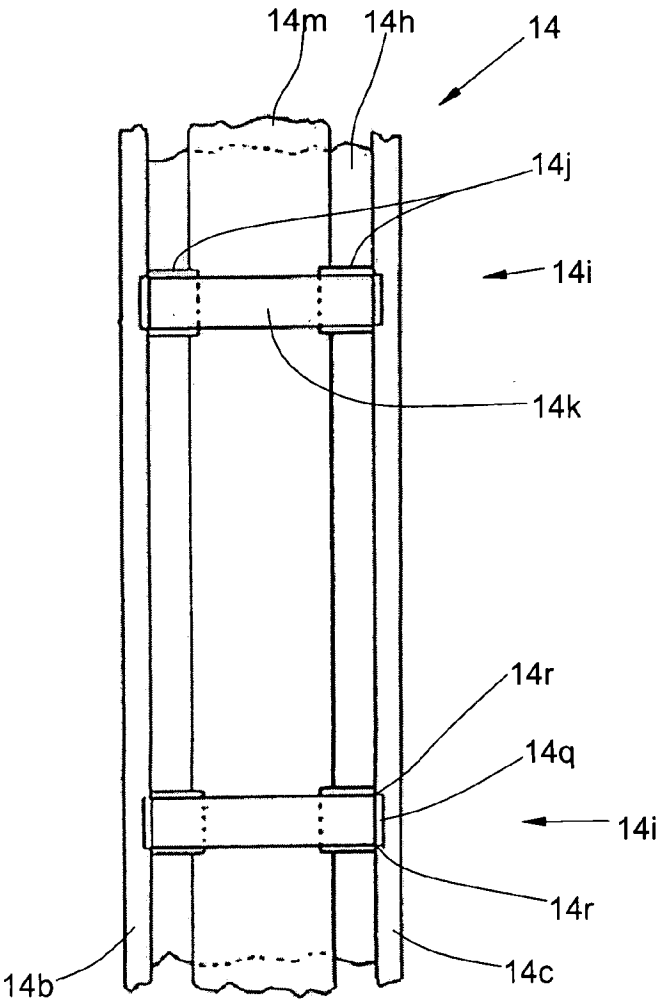
Figure 11C:
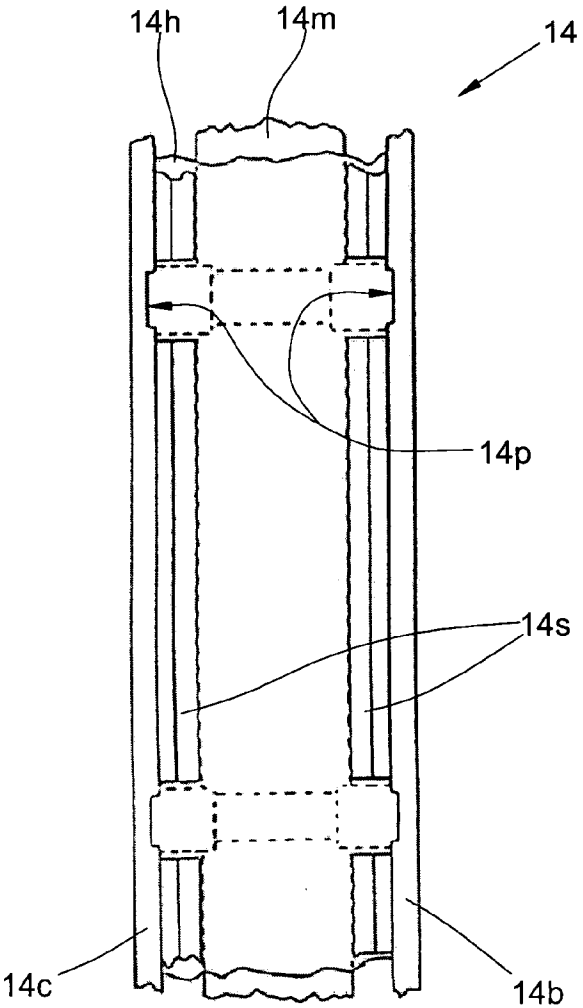

Interlocking male and/or female panel side edges are provided on a variety of other panels of the interlocking construction system for providing side-to-side structural engagement of panels. These include: male and female gable end panels 7 and 8 (FIG. 5), gable center panel 10 (FIG. 4), and gable side panel 11 (FIG. 4); window-related panels including window header panels 18, window panels 19, window base panels 20 (FIG. 8); door-related panels including male and female door panels 21 and 22 (FIG. 9).

In addition to providing side-to-side structural engagement of panels, the interlocking construction system must also provide for end-engagement of panels. For example: wall panels 14/15/16/17 must engage at their lower ends floor panels 24/25/26 and/or sill elements 13 and/or lower-story wall segments (not shown); wall panels 14/15/16/17 must engage at their upper ends floor panels 24/25/26 and/or gable panels 7/8/10/11 and/or upper-story wall segments (not shown) and/or roof panels 3/4/5; roof panels 3/4/5 must engage roof cap elements 1 and/or roof ridge elements 2 and/or fascia elements 6; floor panels 24/25/26 must engage sill elements 13 and/or wall panels 14/15/16/17; gable ends 7/8/10/11 must engage at their lower ends wall panels 14/15/16/17 and must engage at their upper ends roof panels 3/4/5. For enabling end-engagement of building panels, the framing members may be adapted for engaging framing members of other end-engaged panels, and header elements may be provided for facilitating end-engagement of panels.

The interlocking construction system includes a wall header element 9 for facilitating engagement of such end-to-end-engaged building panels. Wall header element 9 (FIG. 6) comprises a pair of spaced-apart substantially parallel elongated facing members 92 with a plurality of header support members 94 positioned therebetween and secured thereto. The header support members are arranged generally vertically and extend above and below the facing members, and are each provided with a notch 96 at the lower end and a tab 98 at the upper end. For end-to-end engagement of panels, the ends of the framing members may be provided with either a notch or a protruding tab. After assembly of a row of wall panels 14, for example, wall header element 9 is placed on top of the wall panels with the upper ends of framing members 14*h* protruding upward between facing members 92. Gable panels 7/8/10/11, for example, may then be placed on wall header element 9 with the lower ends of framing members 7*h*/8*h*/10*h*/11*h* protruding downward between facing elements 92. The ends of the framing members 14*h* and 7*h*/8*h*/10*h*/11*h* may engage one another between the facing members 92 of the wall header section 9, with the tabs 14*u* inserted into notches 7*v*/8*v*/10*v*/11*v*. Vertical loads are transmitted downward from framing members 7*h*/8*h*10*h*/11*h* to framing members 14*h*. The header support members 94 are engaged at their lower ends with the upper ends of framing members 14*m* of wall panels 14, with a tabs 14*w* thereof inserted into notches 96. The header support members 94 are engaged at their upper ends with the lower ends of framing members 7*m*/8*m*/10*m*/11*m* of gable panels 7/8/10/11, with notches 7*x*/8*x*/10*x*/11*x* receiving tabs 98. Vertical loads are transmitted from framing members 7*m*/8*m*/10*m*/11*m* through header support members 94 to framing members 14*m*.

Wall header elements 9 may also be employed for engaging the tops of wall panels 14 and roof panels 3/4/5. The roof panels 4 include additional framing members 42 set at an angle relative to sheathing members 4*b* and 4*c* and framing member 4*h*. Framing members 42 include notch 44 at a lower end thereof for receiving tab 14*u* at the tops of framing members 14*h* of wall panels 14. Framing members 14*h* and 42 are engaged with each other between facing members 92 of wall header element 9. Roof panels 3/4/5 each also include a cross members 36/46/56, respectively, which upon assembly are positioned against a side surface of header support members 92 when roof panels 3/4/5 are engaged with wall header element 9. Additional framing members (within the roof panels 3/4/5 and not visible in the Figures; configured similarly to framing members 42) receive tab 98 at the upper end of support members 94.

Figure 6:
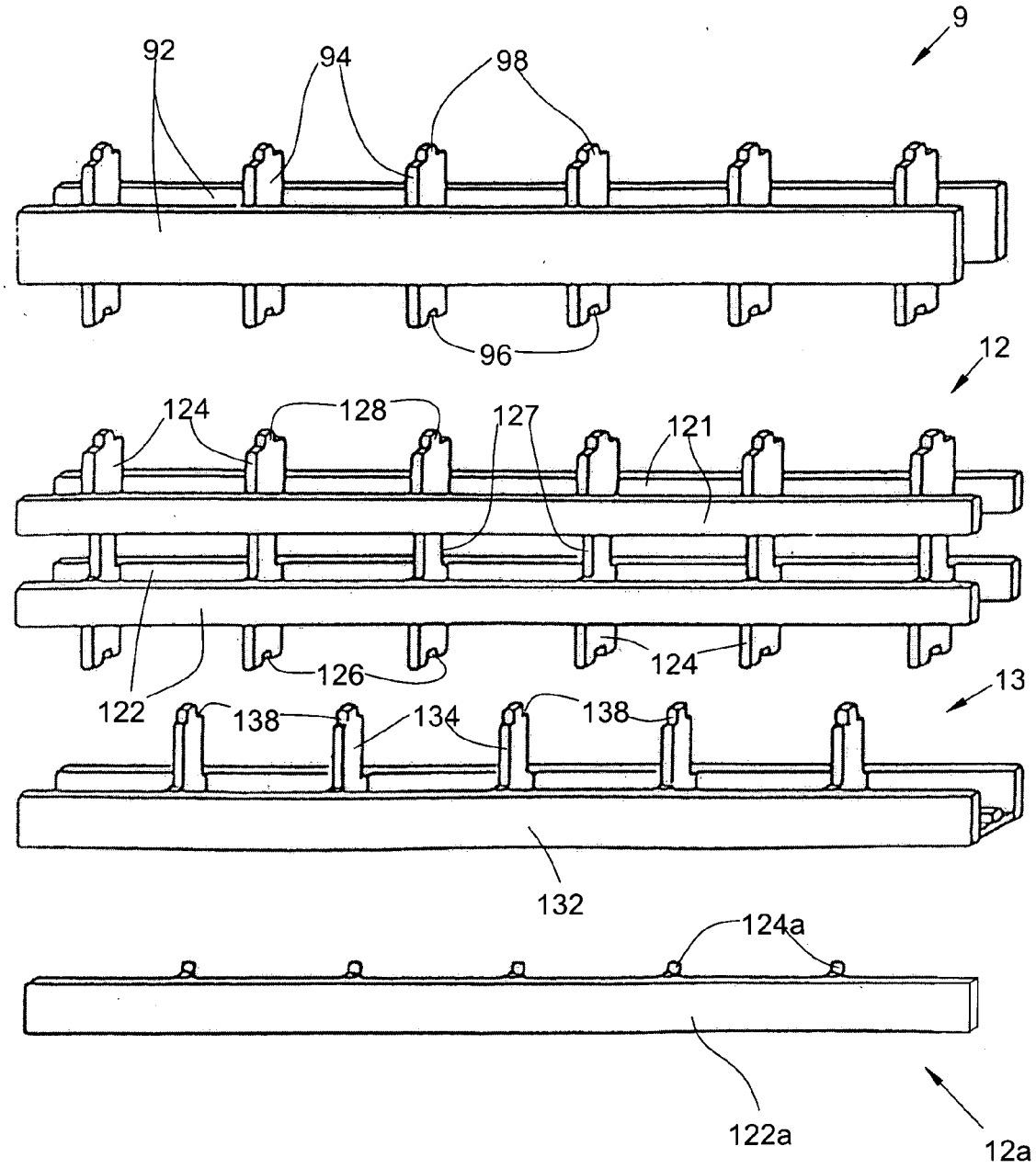
FIG. 6 illustrates a wall header element, a wall/floor header element, a sill element, and an access element of the interlocking construction system.
Figure 7:
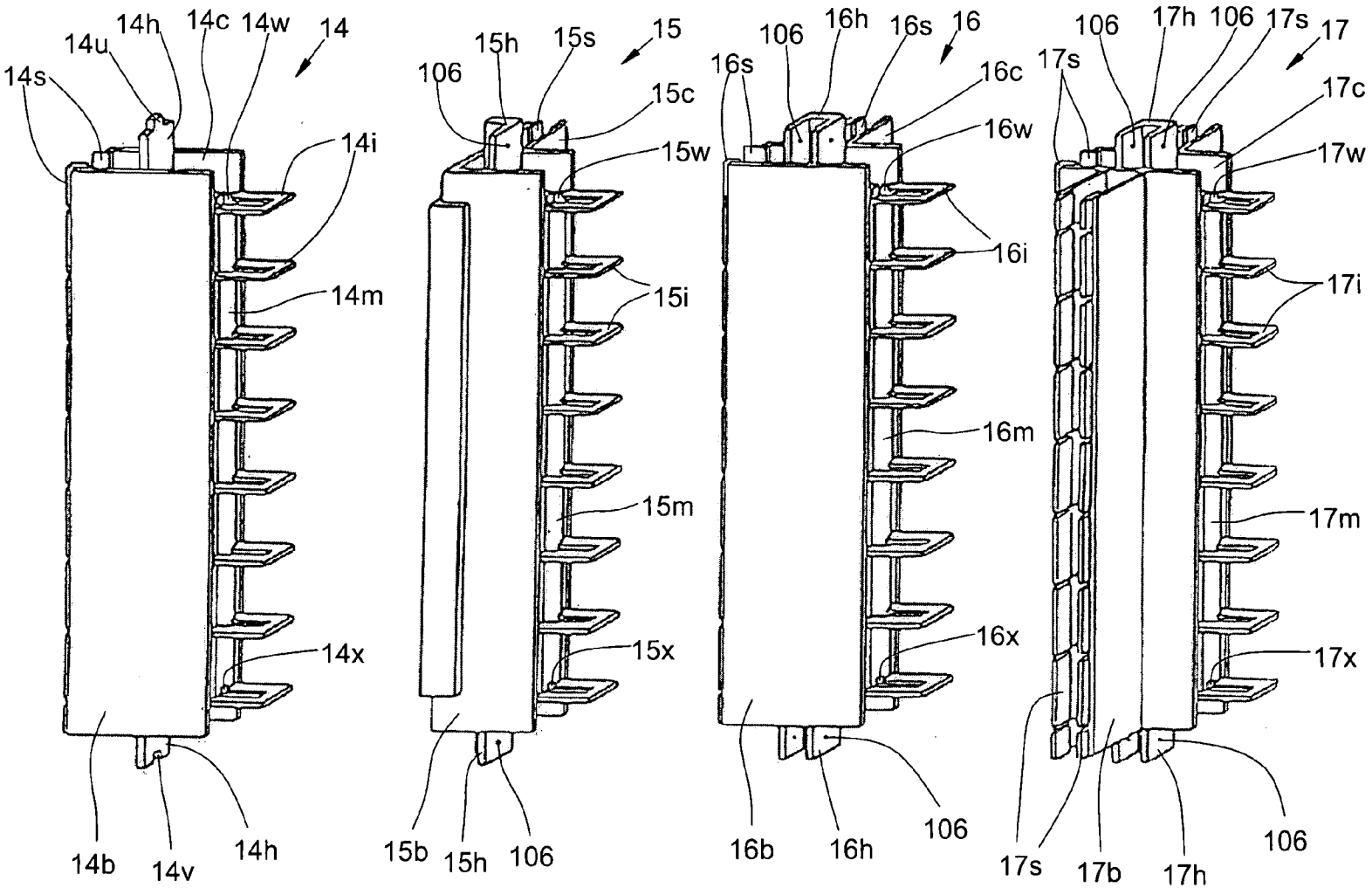
FIG. 7 illustrates a wall panel, a two-wall corner panel, a three-wall corner panel, and a four-wall corner panel of the interlocking construction system.
Figure 8:
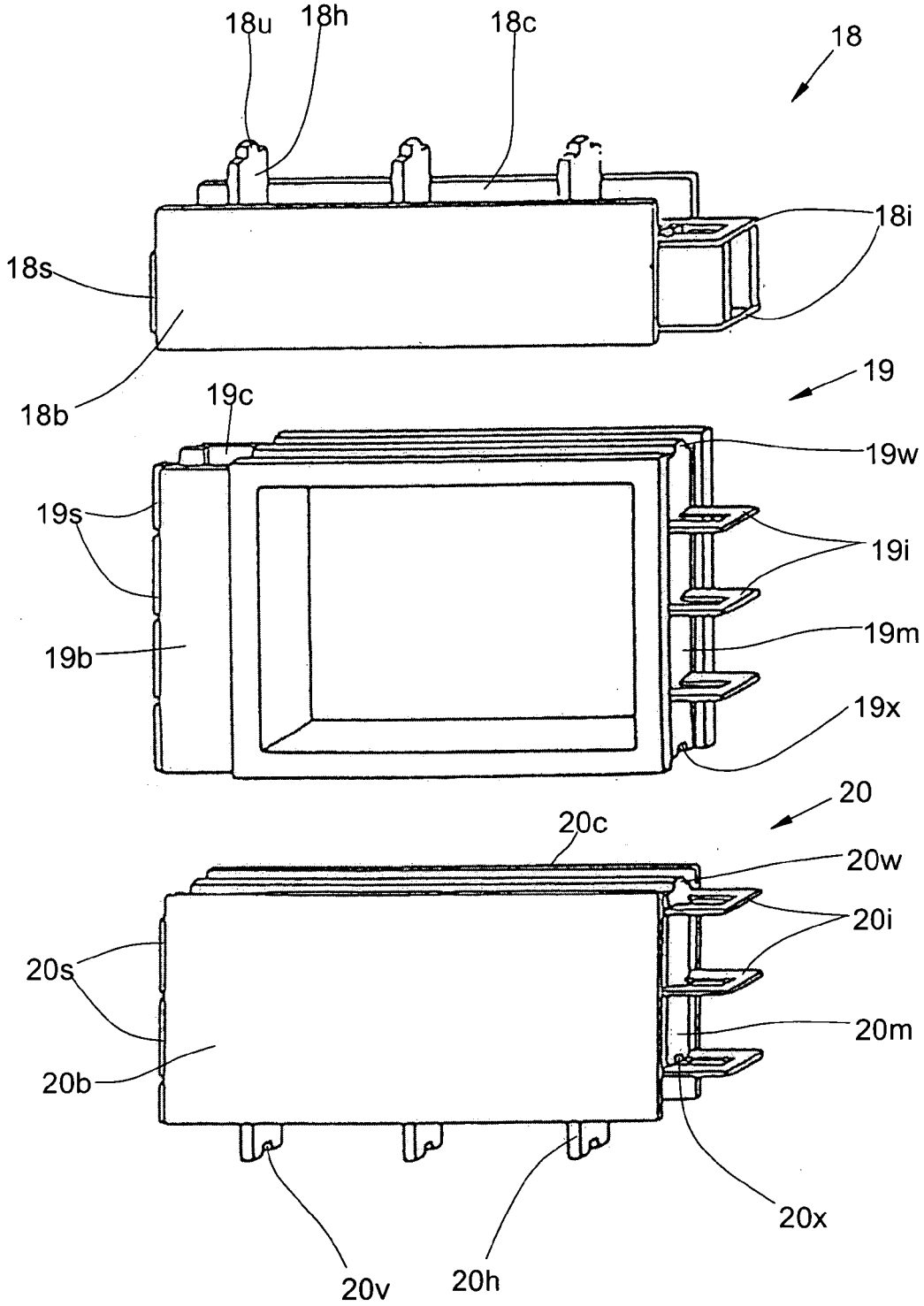
FIG. 8 illustrates a window header panel, a window panel, and a window base panel of the interlocking construction system.

The ends of the interlocking building panels may also engage other panels at about a right angle, for example, where floors/ceilings meet walls. The ends of floor panels 24/25/26 are adapted for enabling such right-angled engagement, including protruding ends of framing members 24*h*/25*h* and 25*m*/26*m*. The framing members function as floor joists in the assembled structure. The protruding ends of the framing members (along with protruding side joist members 24*t*/26*t*) serve to support the edges of the floor/ceiling in the assembled structure. The interlocking construction system includes wall/floor header elements 12 (FIG. 6) for facilitating engagement of floor panels 24/25/26 and wall panels 14 and/or sill elements 13 (FIG. 6). Sill element 13 comprises an elongated trough-like member 132 with a plurality of sill support members 134 secured thereto and extending generally vertically, each sill support member 134 having a pair of lateral notches 138 at its top end. Wall/floor header element 12 comprises upper and lower pairs of elongated facing members 121 and 122 with a plurality of header support members 124 positioned therebetween and secured thereto. The header support members 124 are arranged generally vertically and extend above facing members 121 and below the facing members 122. The header support members 124 are each provided with a notch 126 at the lower end and a tab 128 at the upper end, and with side notches 127. The upper and lower facing members are vertically spaced apart to leave a gap therebetween substantially aligned with side notches 127.

Upon assembly, sill elements 13 are suitably positioned on a supporting surface (leveled ground, concrete slab, foundation, or other suitable surface). Wall/floor header elements are placed thereon, with the lower ends of the header support members 124 resting within member 132. The header support members 124 and sill support members 134 are positioned so as to alternate along the length of the assembled elements 12 and 13. The spacing of joist members of the floor (ends of members 24*h*/25*h*/25*m*/26*m*/24*t*/26*t*) are spaced so that upon assembly, each joist member is inserted between an upper and lower facing member 121/122, and either engages a side notch 127 or a lateral notch 138. In this way all of the floor joist members are supported from below. A second set of floor panels with corresponding floor joist members may be inserted from the other side of wall/floor header element 12 to engage side notches 127 and lateral notches 138 on the other side. If no floor is required on the other side of wall/floor header elements 12, access elements 12*a* may be employed instead, each including a single elongated facing member 122*a* with a plurality of protruding tabs 124*a* thereon. Upon assembly, facing member 122*a* fills the gap between facing members 121/122, while the protruding tabs 124*a* engage side notches 127 and lateral notches 138 in the same manner as the floor joist members.

Once the floor panels 24/25/26 have been assembled with sill elements 13 and wall/floor header elements 12, wall panels 14 (perhaps also including window base panels 20 and/or door panels 21/22) may be assembled thereon. The lower ends of framing members 14*h* rest on the floor joist ends that in turn rest on lateral notches 138 of sill support members 134. If an access element 12*a* is employed, then the lower ends of framing members 14*h* rest partly on protruding tabs 124*a* that in turn rest on lateral notches 138 of sill support members 134. The notches 14*x* of framing members 14*m* receive tabs 128 of header support members 124. Vertical loads are transmitted from framing members 14*h* through floor joist members to sill support members 134 and member 132, and from framing members 14*m* through header support members 124 to element 132. For multi-story structures, this assembly procedure may be repeated, with the upper ends of a group of side-to-side-engaged wall panels 14 (perhaps also including window header panels 18 and/or door panels 21/22) taking the place of sill element 13 and upper ends of framing members 14*h* taking the place of sill support members 134.

If no first (or ground) floor is required, wall header element 9 may be placed on top of sill element 13 (instead of wall/floor header element 12). Together sill element 13 and wall header element 9 provide a base on which to construct a wall using panels 14.

Roof cap elements 1 and roof ridge elements 2 are adapted for engaging the top edges of roof panels 3/4/5 at an angle to form a pitched roof. Roof ridge element 2 comprises an elongated angled roof inner facing member 21 and an elongated outer roof facing member 22 with a plurality of angled roof ridge support members 24 secured thereto, each having a notch 26 at one end thereof and a notch 28 at the other end thereof. The notches 26 along one side of the roof ridge element 2 engage the tabs 3*w*/4*w*/5*w* at the tops of framing members 3*m*/4*m*/5*m* of roof panels 3/4/5 along the first side of the roof. The notches 28 along the other side of the roof ridge element 2 engage tabs 3*u*/4*u*/5*u* at the top ends of framing members 3*h*/4*h*/5*h* of roof panels 3/4/5 along the second side of the roof. Loads on the roof are thereby transmitted between framing members 3*m*/4*m*/5*m* on the first side of the roof to framing members 3*h*/4*h*/5*h* on the second side of the roof. Additional support members between facing members 21 and 22 (not visible in the Figures) engage tabs 3*u*/4*u*/5*u* at the top ends of framing members 3*h*/4*h*/5*h* from the first side of the roof. Roof cap element 1 comprises an elongated angled roof outer facing member 12 with a plurality of angled roof cap support members 14 secured thereto, each having a notch 18 at the lower end thereof. The notches 18 along the roof cap element 1 engage tabs 3*w*/4*w*/5*w* at the top ends of framing members 3*m*/4*m*/5*m* of roof panels 3/4/5 along the second side of the roof. Placement of roof cap element 1 is typically the last step of assembly of a structure, and roof cap element 1 may therefore interlockingly engage only one side of the roof to allow final assembly of the structure. Fascia elements 6 are adapted for engaging the lower ends of roof panels 3/4/5. Fascia element 6 include an elongated trough-like member 62 with a plurality of fascia support members 64 secured thereto, each having a tab 68 at the upper end thereof. The tabs 68 are inserted into notches 3*x*/4*x*/5*x* at the lower ends of framing members 3*m*/4*m*/5*m* of the roof panels 3/4/5, while the lower ends of framing members 3*h*/4*h*/5*h* are inserted into member 62.

Assembly of a room of a structure may proceed around the room perimeter until the last interlocking wall panel is ready for assembly. Such a last interlocking panel would be virtually impossible to assemble without adapting some portion of the overall structure to permit its insertion. Adaptations of door elements 230/232/234 enable assembly of complete room perimeters (since presumably every room requires a door). Assembly of a room perimeter wall may begin at either side of the door (with panel 21 or 22) and proceeds around the room. Alternatively, wall assembly may begin at any point of the wall and proceed in both directions until the door location is reached from both directions. A gap remains between door panels 21 and 22 sufficiently large to enable assembly of the same into the wall. This gap is filled by assembly of upper door jamb 230 into the gap between door panel 21/22. Side door jambs 232 are then wedged into place along the sides of the door, and serve to support upper door jamb element 230 (as well as provide hinge/latch/lock hardware for the door itself). Finally, threshold 234 is placed between the side jambs on the header element (9 or 12 as the case may be). Vertically protruding support members of the header element must be cut down to accommodate placement of threshold 234. Facing elements 92 or 121 may also have portions of their top edges cut down to accommodate threshold 234, if needed or desired.

Once a structure is assembled from a plurality of interlocking building panels as disclosed herein, the assembled panels are adapted for retention so as to maintain structural integrity. If later modification or disassembly of the structure is not desired or needed, any of a wide array of fasteners and/or fastening means may be employed in a wide variety of locations for securing together the assembled building panels. Such fasteners may include nails, screws, bolts, staples, nail plates, other penetrating fasteners, rivets, pins, dowels, glue and/or other adhesives, welding (if the panels include metal components), chemical welding (if the panels and/or elements include plastics and/or composites), combinations thereof, and/or functional equivalents thereof. Examples may include, but are by no means limited to: use of screws, nails, or other penetrating fasteners inserted through the sheathing members of one panel into an underlying spline and/or framing members of a side-to-side-engaged second panel; glue or other adhesive applied to grooves and inserted splines; glue or other adhesive applied to engaged tabs/notches at framing member ends; screws, nails, or other penetrating fasteners inserted through a facing members of a header element into an underlying end of a framing member; and so forth. Many other examples of the use fasteners and/or fastening means may be employed while remaining within the scope of the present disclosure.

The building panels and elements may be adapted for retaining integrity of the assembled structure while nevertheless enabling disassembling of the panels at a later time, particularly if later modification or disassembly of the structure is needed or desired. As shown in the example of FIGS. 12A–12C (illustrating assembly of wall panels 14 and wall corner panels 15 atop a wall/floor header element 12, for example), the inner surfaces of facing members 121 may be provided with a longitudinal slot 123 along the lengths thereof and through any intervening support members 124 secured thereto. The bottom ends of framing members 14*h* inserted between the facing members (for engagement with other framing member ends of other panels) are provided with side slots 14*y*, with the side slots 14*y* being positioned so that they are substantially aligned with the corresponding facing member slots 123 when the panels and header elements are assembled and the framing member ends are engaged. After assembly, a retaining member 102 may be inserted through the slots partially received in each of the facing member slot and the framing member side slots. With the retaining member in place, the framing member ends cannot be removed from between the facing members, and the wall panel is thereby retained assembled with the header element. To disassemble the structure, the retaining members are simply removed from the groove, thereby releasing the building panel from the header element. A single retaining member 102 may be employed, or retaining members may be employed in pairs of opposite sides of the framing member ends. Retaining members 102 may comprise elongated metal strips, but may be constructed from any material sufficiently rigid for inserting through the slots 123/14*y* and for retaining the framing member end between the facing members of the header element. The side slots 14*y* may be suitably reinforced (not shown) for bearing loads applied thereto via retaining member 102. Such reinforcement may be provided in any of a variety of suitable ways. For example, a metal reinforcement plate may be secured to the framing member end substantially parallel to the framing member and substantially perpendicular to the sheathing members. Such a panel may have slots in the edge(s) thereof aligned with side slots 14*y* and adapted for receiving retaining member 102.

The retaining members 102 may be further adapted for retaining multiple wall panels in side-to-side engagement. Each end of retaining members 102 may be connected to a threaded tensioning plate 104. If paired retaining members 102 are used, the threaded tensioning plate 104 may be connected to corresponding ends of both retaining members 102. The ends of framing members of wall corner panels 15/16/17 are provided with a clearance hole 106 therethrough. A threaded bolt 108 is inserted through the hole 106 and threaded into threaded tensioning plate 104 at each end of retaining member(s) 102. The enlarged head portion of bolt 108 prevents its passage through hole 106, so that tightening the threaded bolts 108 serves to tension the retaining member(s) 102 and thereby compressing the wall corner panels (and any wall panels 14 therebetween). In this way an entire row of side-to-side engaged wall panels 14 may be securely retained between corresponding wall corner panels. The holes 106 may be suitably reinforced (not shown) for bearing the tension applied to retaining members. Such reinforcement may be provided by a suitably sized washer for bolt 108, a metal reinforcement plate provided for each hole 106 with a hole therethrough far passing bolt 108 (but not the head thereof), or a reinforcing plate or insert may be provided running the entire length of the framing member of the end-adapted panel with holes at each end corresponding to holes 108.

Various panels of the interlocking construction system may be adapted in a manner similar to the example of FIGS. 12A–12C. Inner surfaces of facing members 12, 21/22, 92, and 121/122/122*a* may be provided with corresponding longitudinal slot(s) along the lengths thereof and through any intervening support members secured thereto. Trough-like members 62 and 132 may be similarly provided with such slots along the inner side surfaces thereof. The framing member ends inserted between the facing members (for engagement with other framing member ends of other panels) or support member ends inserted into trough-like members are provided with side slots (like slots 14*y* for framing members 14*h* of wall panels 14), with the side slots being positioned so that they are substantially aligned with the corresponding facing member slots or trough-member slots when the panels and header elements are assembled and the framing member ends are engaged. After assembly, a retaining member 102 may be inserted through the slots partially received in each of the facing member slot and 11 the framing member side slot. With the retaining member in place, the framing member ends cannot be removed from between the facing members, and the building panel is thereby retained assembled with the header, roof cap, roof ridge, fascia, or sill element. To disassemble the structure, the retaining members are simply removed from the groove, thereby releasing the building panel from the assembled element. Single retaining members 102 may be employed within each header, roof cap, roof ridge, fascia, or sill element, or retaining members may be employed in pairs in these elements on opposite sides of the framing member ends. Retaining members 102 may comprise elongated metal strips, but may be constructed from any material sufficiently rigid for inserting through the slots and for retaining the framing member end assembled with the header, roof cap, roof ridge, fascia, or sill element.

The retaining members 102 may be further adapted for retaining multiple panels of various sorts in side-to-side engagement. Each end of retaining members 102 may be connected to a threaded tensioning plate 104 as described hereinabove. The ends of framing members of end-adapted building panels (female/male roof end panels 3/5, two-/three-/four-wall corner panels 15/16/17, male/female gable end panels 7/8) are provided with a clearance hole 106 therethrough. A threaded bolt 108 serves to tension the retaining member(s) 102 and thereby compressing the end-adapted building panels (and any additional building panels therebetween), as described hereinabove. In this way an entire row of side-to-side engaged building panels (wall panels 14, roof panels 4, gable panels 10/11) may be securely retained between corresponding end-adapted building panels. The holes 106 may be suitably reinforced for bearing the tension applied to retaining members as described hereinabove. For wall corner panels 15/16/17 (in which the corresponding framing members 15*h*/16*h*/17 have an angled or channeled structure), a reinforcing member may be provided in the form of a four-sided partial cube with holes at the center of the four faces. Each of three holes are directed horizontally and line up with holes in the framing members for passing bolts 108. The fourth hole may be directed vertically and may serve for securing the wall corner panel 15/16/17 to other panels above and/or below.

The exemplary embodiments have been shown with notches at the lower ends of framing members of various interlocking panels and support members of various interlocking elements, and with protruding tabs at the upper ends of the same, thereby enabling engagement of various interlocking panels and/or interlocking elements with their framing members engaged. It should be appreciated that substantially equivalent interlocking panels/elements may be employed with protruding tabs at the lower ends of framing/support members and notches at upper ends thereof. It should be further appreciated that substantially equivalent interlocking panels/elements may be employed with any suitable shape or configuration at the top ends of framing/support members and substantially complementary shape or configuration at the lower ends thereof for engaging the same, while remaining within the scope of the present disclosure and/or appended claims.

The various panels and elements of the interlocking construction system may typically be manufactured from wood or wood products. Other materials or combinations thereof may be employed as well, including metals, plastics (including recycled materials), fiber-based materials, composites, and so forth. The components of each individual panel or element may be secured together by any of a wide array of fasteners and/or fastening means. These may include, but are by no means limited to, nails, screws, bolts, staples, nail plates, other penetrating fasteners, rivets, pins, dowels, glue and/or other adhesives, welding, chemical welding, combinations thereof, and/or functional equivalents thereof.

The parts for manufacturing the panels of the interlocking construction system may be fabricated using standardized and/or automated procedures. Sheathing members are only needed in a few standard sizes, and should all be provided with substantially identically sized and spaced grooves for receiving the side members of the splines. The splines of differing parts may be substantially identically configured, as well as the framing members between the splines and the sheathing leaf members, thereby standardizing the fabrication of these parts. Somewhat more specificity arises when fabricating framing members for wall panels vs. wall corner panels vs. floor panels vs. roof panels, and between center panels and end-adapted panels. Header elements, sill elements, and roof cap and ridge elements also differ, but nevertheless offer substantially commonality of fabrication.

Assembly of a structure using the interlocking construction system may be readily accomplished by as few as two workers using a few standard hand tools (mainly for tightening the tensioning bolts). The panels with their framing members, grooves, splines, and so forth may be manufactured offsite at a manufacturing facility, and therefore may arrive at the construction site ready for assembly. Panels may even be pre-finished and/or pre-painted before delivery to the construction site.

Full-scale prototype testing indicated that structures assembled from panels of the interlocking construction system exhibit significantly larger capacities for lateral and/or shear loads than comparable structures constructed using conventional techniques.

It is intended that modifications to the disclosed embodiments may be made without departing from inventive concepts disclosed and/or claimed herein.

What is claimed is:

1. A system comprising a plurality of interlocking building panels, wherein each of the panels comprises:

a first sheathing member having an inner surface, an outer surface, substantially parallel first and second side edges, and first and second ends;

a second sheathing member having an inner surface, an outer surface, substantially parallel first and second side edges, and first and second ends, the first and second sheathing members having corresponding shapes with corresponding first and second side edges and corresponding first and second ends, the first and second sheathing members being arranged in a spaced-apart arrangement with corresponding sides edges and corresponding ends substantially aligned and with respective inner surfaces facing each other; and at least one elongated framing member positioned between the first and second sheathing members and secured to each, the framing member being arranged substantially parallel to the first and second side edges, wherein at least one of the panels further comprises a male panel side edge, and at least one other of the panels comprises a female panel side edge, wherein the male panel side edge comprises a plurality of splines, each spline extending proximally between the first and second sheathing members and secured to each, each spline extending distally from the corresponding first side edges of the sheathing members in a direction substantially perpendicular to the side edges, the splines each comprising a pair of substantially parallel first and second side members, the first and second side members being secured to the inner surfaces of the first and second sheathing members, respectively, in substantially opposing positions and extending distally from the side edges of the sheathing members, wherein the female panel side edge comprises a plurality of opposing pairs of substantially parallel grooves, one groove of each pair being positioned on the inner surface of each sheathing member and extending proximally from the second side edge thereof in a direction substantially perpendicular to the second side edge, wherein the female panel edge is adapted for engaging a male panel edge of at least one other similarly adapted building panel with splines of the other building panel received within the grooves of the female panel edge, wherein the male panel edge is adapted for engaging a female panel edge of at least one other similarly adapted building panel with the splines of the male panel edge inserted into grooves of the other building panel, and wherein the male panel side edge further comprises an elongated framing member positioned between the side members of the splines and secured thereto, the framing member being arranged substantially parallel to the sheathing member side edges.

2. The system of claim 1, at least one panel comprising both a female panel side edge and a male panel side edge.

3. The system of claim 1, at least one panel comprising either a male panel side edge or a female panel side edge.

4. The system of claim 1, at least one panel comprising:

a first panel side edge comprising either a male panel side edge or a female panel side edge; and a second panel side edge comprising a finished outer surface.

5. The system of claim 1, the splines having beveled distal portions thereof for facilitating insertion thereof into the grooves of the other building panel.

6. The system of claim 1, the splines each having an outer surface with a raised central longitudinal portion and recessed longitudinal edges, the raised central longitudinal portion for insertion into a groove of the other building panel, the recessed longitudinal edges for engaging the inner surface of a sheathing member of the other building panel.

7. The system of claim 1, the splines each further comprising a center member connecting the first and second side members near distal ends thereof, the spline thereby being configured in a "U"-shape, the center member being arranged substantially perpendicular to portions of the sheathing members near the male side edge.

8. The system of claim 1, the female side edge further comprising a plurality of elongated sheathing leaf members, the sheathing leaf members being secured between adjacent grooves to the inner surfaces of the sheathing members at the second side edges thereof and arranged substantially parallel thereto, the sheathing leaf members extending distally beyond the second side edges of the sheathing members, the sheathing leaf members being thereby adapted for insertion between sheathing members of the other building panel.

9. The system of claim 8, the sheathing leaf members having beveled distal portions thereof for facilitating insertion thereof between sheathing members of the other building panel.

10. The system of claim 1, at least one end of the framing member being adapted for engaging an end of a framing member of another similarly adapted building panel, thereby end-engaging the building panels.

11. The system of claim 10, the framing members being substantially parallel when the framing members are engaged, thereby end-engaging the building panels end-to-end.

12. The system of claim 11, the ends of the framing members having a notch and tab, respectively, the tab being received within the notch when the framing members are engaged.

13. The system of claim 11, further comprising at least one header element adapted for positioning between the building panels when the framing members are engaged, the header element comprising at least one pair of elongated facing members and a plurality of header support members positioned therebetween and secured thereto, the header element being adapted for receiving the framing member ends between the facing members when the framing members are engaged, the header support members extending beyond the facing members for engaging other framing members of the building panels when the building panels are engaged end-to-end.

14. The system of claim 13, the facing members being adapted for retaining the framing member ends therebetween.

15. The system of claim 13, at least one of the facing members including at least one slot along an inner surface thereof, at least one of the framing members including a corresponding slot therein, the slots being arranged so as to be substantially aligned opposite one another when the framing member ends are engaged between the facing members, the system further including an elongated retaining member adapted for insertion through the slots when aligned, thereby retaining at least one of the engaged building panels with the framing member thereof between the facing members of the header element.

16. The system of claim 15, the header element being adapted for receiving framing member ends of multiple similarly adapted building panels between the facing members, the multiple building panels being engaged side-to-side, the retaining member being adapted at ends thereof for retaining the multiple building panels in side-to-side engagement.

17. The system of claim 16, each end of the retaining member being threadedly engaged with a threaded member, the threaded member passing through a hole in a framing member end of an end building panel of the multiple side-to-side engaged building panels, the threaded member rotatable within the hole, the threaded member having an enlarged head end thereof preventing passage of the threaded member through the hole toward the retaining member, thereby enabling compression of the side-to-side engaged building panels by tightening of the threaded member.

18. The system of claim 10, the engaged framing members being substantially perpendicular when the framing members are engaged, thereby end-engaging the building panels in a substantially perpendicular arrangement.

19. The system of claim 18, further including at least one header element adapted for positioning between the building panels when the framing members are end-engaged, the header element comprising at least one pair of elongated facing members and a plurality of header support members positioned between and secured to the facing members, the header element being adapted for receiving between the facing members the framing member end of a first perpendicular-engaged building panel when the framing members are engaged, the header support members extending beyond the facing members for engaging other framing members of the first perpendicular-engaged building panel when the framing members are engaged, the header support members further including a side notch for engaging other framing members of a second perpendicular-engaged building panel when the framing members are engaged.

20. The system of claim 19, the facing members being adapted for retaining the framing member end of the first perpendicular-engaged building panel therebetween.

21. A building constructed at least in part from a plurality of interlocking building panels, wherein each of the panels comprises:

a first sheathing member having an inner surface, an outer surface, substantially parallel first and second side edges, and first and second ends;

a second sheathing member having an inner surface, an outer surface, substantially parallel first and second side edges, and first and second ends, the first and second sheathing members having corresponding shapes with corresponding first and second side edges and corresponding first and second ends, the first and second sheathing members being arranged in a spaced-apart arrangement with corresponding sides edges and corresponding ends substantially aligned and with respective inner surfaces facing each other; and at least one elongated framing member positioned between the first and second sheathing members and secured to each, the framing member being arranged substantially parallel to the first and second side edges, wherein at least one of the panels further comprises a male panel side edge, and at least one other of the panels comprises a female panel side edge, wherein the male panel side edge comprises a plurality of splines, each spline extending proximally between the first and second sheathing members and secured to each, each spline extending distally from the corresponding first side edges of the sheathing members in a direction substantially perpendicular to the side edges, the splines each comprising a pair of substantially parallel first and second side members, the first and second side members being secured to the inner surfaces of the first and second sheathing members, respectively, in substantially opposing positions and extending distally from the side edges of the sheathing members, wherein the female panel side edge comprises a plurality of opposing pairs of substantially parallel grooves, one groove of each pair being positioned on the inner surface of each sheathing member and extending proximally from the second side edge thereof in a direction substantially perpendicular to the second side edge, wherein the female panel edge is adapted for engaging a male panel edge of at least one other similarly adapted building panel with splines of the other building panel received within the grooves of the female panel edge, wherein the male panel edge is adapted for engaging a female panel edge of at least one other similarly adapted building panel with the splines of the male panel edge inserted into grooves of the other building panel, and wherein the male panel side edge further comprises an elongated framing member positioned between the side members of the splines and secured thereto, the framing member being arranged substantially parallel to the sheathing member side edges.

22. The building of claim 21, at least one panel comprising both a female panel side edge and a male panel side edge.

23. The building of claim 21, at least one panel comprising either a male panel side edge or a female panel side edge.

24. The building of claim 21, at least one panel comprising:

a first panel side edge comprising either a male panel side edge or a female panel side edge; and a second panel side edge comprising a finished outer surface.

25. The building of claim 21, the splines having beveled distal portions thereof for facilitating insertion thereof into the grooves of the other building panel.

26. The building of claim 21, the splines each having an outer surface with a raised central longitudinal portion and recessed longitudinal edges, the raised central longitudinal portion for insertion into a groove of the other building panel, the recessed longitudinal edges for engaging the inner surface of a sheathing member of the other building panel.

27. The building of claim 21, the splines each further comprising a center member connecting the first and second side members near distal ends thereof, the spline thereby being configured in a "U" -shape, the center member being arranged substantially perpendicular to portions of the sheathing members near the male side edge.

28. The building of claim 21, the female side edge further comprising a plurality of elongated sheathing leaf members, the sheathing leaf members being secured between adjacent grooves to the inner surfaces of the sheathing members at the second side edges thereof and arranged substantially parallel thereto, the sheathing leaf members extending distally beyond the second side edges of the sheathing members, the sheathing leaf members being thereby adapted for insertion between sheathing members of the other building panel.

29. The building of claim 28, the sheathing leaf members having beveled distal portions thereof for facilitating insertion thereof between sheathing members of the other building panel.

30. The building of claim 21, at least one end of the framing member being adapted for engaging an end of a framing member of another similarly adapted building panel, thereby end-engaging the building panels.

31. The building of claim 30, the framing members being substantially parallel when the framing members are engaged, thereby end-engaging the building panels end-to-end.

32. The building of claim 31, the ends of the framing members having a notch and tab, respectively, the tab being received within the notch when the framing members are engaged.

33. The building of claim 31, further comprising at least one header element adapted for positioning between the building panels when the framing members are engaged, the header element comprising at least one pair of elongated facing members and a plurality of header support members positioned therebetween and secured thereto, the header element being adapted for receiving the framing member ends between the facing members when the framing members are engaged, the header support members extending beyond the facing members for engaging other framing members of the building panels when the building panels are engaged end-to-end.

34. The building of claim 33, the facing members being adapted for retaining the framing member ends therebetween.

35. The building of claim 33, at least one of the facing members including at least one slot along an inner surface thereof, at least one of the framing members including a corresponding slot therein, the slots being arranged so as to be substantially aligned opposite one another when the framing member ends are engaged between the facing members, the system further including an elongated retaining member adapted for insertion through the slots when aligned, thereby retaining at least one of the engaged building panels with the framing member thereof between the facing members of the header element.

36. The building of claim 35, the header element being adapted for receiving framing member ends of multiple similarly adapted building panels between the facing members, the multiple building panels being engaged side-to-side, the retaining member being adapted at ends thereof for retaining the multiple building panels in side-to-side engagement.

37. The building of claim 36, each end of the retaining member being threadedly engaged with a threaded member, the threaded member passing through a hole in a framing member end of an end building panel of the multiple side-to-side engaged building panels, the threaded member rotatable within the hole, the threaded member having an enlarged head end thereof preventing passage of the threaded member through the hole toward the retaining member, thereby enabling compression of the side-to-side engaged building panels by tightening of the threaded member.

38. The building of claim 30, the engaged framing members being substantially perpendicular when the framing members are engaged, thereby end-engaging the building panels in a substantially perpendicular arrangement.

39. The building of claim 38, further including at least one header element adapted for positioning between the building panels when the framing members are end-engaged, the header element comprising at least one pair of elongated facing members and a plurality of header support members positioned between and secured to the facing members, the header element being adapted for receiving between the facing members the framing member end of a first perpendicular-engaged building panel when the framing members are engaged, the header support members extending beyond the facing members for engaging other framing members of the first perpendicular-engaged building panel when the framing members are engaged, the header support members further including a side notch for engaging other framing members of a second perpendicular-engaged building panel when the framing members are engaged.

40. The building of claim 39, the facing members being adapted for retaining the framing member end of the first perpendicular-engaged building panel therebetween.

41. The building of claim 21, the plurality of building panels including a wall panel, a wall corner panel, a floor panel, a floor end panel, a window-related panel, a door-related panel, a gable panel, a gable end panel, a roof panel, a roof end panel, a roof fascia element, a roof cap element, a roof ridge element, a wall header element, a floor/wall header element, or a sill element.

42. The building of claim 41, the plurality of building panels including at least one wall panel, the wall panel comprising both male and female side edges;

the framing member of the wall panel extending beyond the ends of the sheathing members, a first framing member end having a protruding tab, a second framing member end having a notch, the first and second ends of the framing member having side slots thereon adapted for receiving a retaining member;

the splines of the male panel side edge of the wall panel each comprising a pair of substantially parallel first and second side members, the first and second side members being secured to the inner surfaces of the first and second sheathing members, respectively, in substantially opposing positions and extending distally from the side edges of the sheathing members;

the male panel side edge of the wall panel further comprising a second elongated framing member positioned between the side members of the splines and secured thereto, the second framing member being arranged substantially parallel to the sheathing member side edges, a first end of the second framing member having a protruding tab, a second end of the second framing member having a notch;

the female side edge of the wall panel further comprising a plurality of elongated sheathing leaf members, the sheathing leaf members being secured between adjacent grooves to the inner surfaces of the sheathing members at the second side edges thereof and arranged substantially parallel thereto, the sheathing members extending distally beyond the second side edges of the sheathing members, the sheathing leaf members being thereby adapted for insertion between sheathing members of another side-engaged building panel.

43. The building of claim 41, the plurality of building panels including at least one wall corner panel, the wall corner panel comprising both male and female side edges;

the sheathing members of the wall corner panel comprising angled sheathing members;

the framing member of the wall corner panel extending beyond the ends of the sheathing members, ends of the framing member being provided with a hole and a threaded member rotatably inserted therethrough, the threaded member being adapted for threadedly engaging a retaining member for retaining at least one side-engaged wall panel;

the splines of the male panel side edge of the wall corner panel each comprising a pair of substantially parallel first and second side members, the first and second side members being secured to the inner surfaces of the first and second sheathing members, respectively, in substantially opposing positions and extending distally from the side edges of the sheathing members;

the male panel side edge of the wall corner panel further comprising a second elongated framing member positioned between the side members of the splines and secured thereto, the second framing member being arranged substantially parallel to the sheathing member side edges, a first end of the second framing member having a protruding tab, a second end of the second framing member having a notch;

the female side edge of the wall corner panel further comprising a plurality of elongated sheathing leaf members, the sheathing leaf members being secured between adjacent grooves to the inner surfaces of the sheathing members at the second side edges thereof and arranged substantially parallel thereto, the sheathing members extending distally beyond the second side edges of the sheathing members, the sheathing leaf members being thereby adapted for insertion between sheathing members of another side-engaged building panel.

44. The building of claim 41, the plurality of building panels including at least one floor panel:

the floor panel comprising both male and female side edges;

the framing member of the floor panel extending beyond the ends of the sheathing members and being adapted for providing vertical support for the floor panel;

the splines of the male panel side edge of the floor panel each comprising a pair of substantially parallel first and second side members, the first and second side members being secured to the inner surfaces of the first and second sheathing members, respectively, in substantially opposing positions and extending distally from the side edges of the sheathing members;

the male panel side edge of the floor panel further comprising a second elongated framing member positioned between the side members of the splines and secured thereto, the second framing member being arranged substantially parallel to the sheathing member side edges, the second framing member extending beyond the ends of the sheathing members and being adapted for providing vertical support for the floor panel;

the female side edge of the floor panel further comprising a plurality of elongated sheathing leaf members, the sheathing leaf members being secured between adjacent grooves to the inner surfaces of the sheathing members at the second side edges thereof and arranged substantially parallel thereto, the sheathing members extending distally beyond the second side edges of the sheathing members, the sheathing leaf members being thereby adapted for insertion between sheathing members of another side-engaged building panel.

45. The building of claim 41, the plurality of building panels including at least one floor end panel:

a first panel side edge of the floor end panel comprising either a male side edge or a female side edge;

a second panel side edge of the floor end panel comprising a plurality of side joist members protruding from between the sheathing members substantially perpendicularly from the second panel side edge, the side joist members being adapted for providing vertical support for the floor end panel;

the framing member of the floor end panel extending beyond the ends of the sheathing members and being adapted for providing vertical support for the floor end panel;

the splines of the male panel side edge of the floor end panel each comprising a pair of substantially parallel first and second side members, the first and second side members being secured to the inner surfaces of the first and second sheathing members, respectively, in substantially opposing positions and extending distally from the side edges of the sheathing members;

the male panel side edge of the floor end panel further comprising a second elongated framing member positioned between the side members of the splines and secured thereto, the second framing member being arranged substantially parallel to the sheathing member side edges, the second framing member extending beyond the ends of the sheathing members and being adapted for providing vertical support for the floor end panel;

the female side edge of the wall end panel further comprising a plurality of elongated sheathing leaf members, the sheathing leaf members being secured between adjacent grooves to the inner surfaces of the sheathing members at the second side edges thereof and arranged substantially parallel thereto, the sheathing members extending distally beyond the second side edges of the sheathing members, the sheathing leaf members being thereby adapted for insertion between sheathing members of another side-engaged building panel.

46. The building of claim 41, the plurality of building panels including at least one window-related panel:

the window-related panel comprising both male and female side edges;

the framing member of the window-related panel extending beyond the ends of the sheathing members, a first framing member end having a protruding tab, a second framing member end having a notch, the first and second ends of the framing member having side slots thereon adapted for receiving a retaining member;

the splines of the male panel side edge of the window-related panel each comprising a pair of substantially parallel first and second side members, the first and second side members being secured to the inner surfaces of the first and second sheathing members, respectively, in substantially opposing positions and extending distally from the side edges of the sheathing members;

the male panel side edge of the window-related panel further comprising a second elongated framing member positioned between the side members of the splines and secured thereto, the second framing member being arranged substantially parallel to the sheathing member side edges, a first end of the second framing member having a protruding tab, a second end of the second framing member having a notch;

the female side edge of the window-related panel further comprising a plurality of elongated sheathing leaf members, the sheathing leaf members being secured between adjacent grooves to the inner surfaces of the sheathing members at the second side edges thereof and arranged substantially parallel thereto, the sheathing members extending distally beyond the second side edges of the sheathing members, the sheathing leaf members being thereby adapted for insertion between sheathing members of another side-engaged building panel.

47. The building of claim 41, the plurality of building panels including at least one door-related panel:

a first panel side edge of the door-related panel being one of comprising either a male side edge or a female side edge;

a second panel side edge of the door-related panel being adapted for engaging door elements;

the framing member of the door-related panel extending beyond the ends of the sheathing members, a first framing member end having a protruding tab, a second framing member end having a notch, the first and second ends of the framing member having side slots thereon adapted for receiving a retaining member;

the splines of the male panel side edge of the door-related panel each comprising a pair of substantially parallel first and second side members, the first and second side members being secured to the inner surfaces of the first and second sheathing members, respectively, in substantially opposing positions and extending distally from the side edges of the sheathing members;

the male panel side edge of the wall panel further comprising a second elongated framing member positioned between the side members of the splines and secured thereto, the second framing member being arranged substantially parallel to the sheathing member side edges, a first end of the second framing member having a protruding tab, a second end of the second framing member having a notch;

the female side edge of the wall panel further comprising a plurality of elongated sheathing leaf members, the sheathing leaf members being secured between adjacent grooves to the inner surfaces of the sheathing members at the second side edges thereof and arranged substantially parallel thereto, the sheathing members extending distally beyond the second side edges of the sheathing members, the sheathing leaf members being thereby adapted for insertion between sheathing members of another side-engaged building panel.

48. The building of claim 41, the plurality of building panels including at least one gable panel:

a first panel side edge of the gable panel comprising either a male side edge or a female side edge;

the framing member of the gable panel extending beyond the lower ends of the sheathing members, a lower framing member end having at least one of a notch and a protruding tab, the bottom end of the framing member having side slots thereon adapted for receiving a retaining member;

the splines of the male panel side edge of the gable panel each comprising a pair of substantially parallel first and second side members, the first and second side members being secured to the inner surfaces of the first and second sheathing members, respectively, in substantially opposing positions and extending distally from the side edges of the sheathing members;

the male panel side edge of the gable panel further comprising a second elongated framing member positioned between the side members of the splines and secured thereto, the second framing member being arranged substantially parallel to the sheathing member side edges, a lower end of the second framing member having at least one of a notch and a protruding tab;

the female side edge of the gable panel further comprising a plurality of elongated sheathing leaf members, the sheathing leaf members being secured between adjacent grooves to the inner surfaces of the sheathing members at the second side edges thereof and arranged substantially parallel thereto, the sheathing members extending distally beyond the second side edges of the sheathing members, the sheathing leaf members being thereby adapted for insertion between sheathing members of another side-engaged building panel.

49. The building of claim 41, the plurality of building panels including at least one roof panel:

the roof panel comprising both male and female side edges;

the framing member of the roof panel extending beyond the ends of the sheathing members, a first framing member end having a protruding tab, a second framing member end having a notch, the first and second ends of the framing member having side slots thereon adapted for receiving a retaining member;

the splines of the male panel side edge of the roof panel each comprising a pair of substantially parallel first and second side members, the first and second side members being secured to the inner surfaces of the first and second sheathing members, respectively, in substantially opposing positions and extending distally from the side edges of the sheathing members;

the male panel side edge of the roof panel further comprising a second elongated framing member positioned between the side members of the splines and secured thereto, the second framing member being arranged substantially parallel to the sheathing member side edges, a first end of the second framing member having a protruding tab, a second end of the second framing member having a notch;

the roof panel having an intermediate framing member with a notch or a protruding tab at an end thereof for engaging an end of another building panel;

the female side edge of the roof panel further comprising a plurality of elongated sheathing leaf members, the sheathing leaf members being secured between adjacent grooves to the inner surfaces of the sheathing members at the second side edges thereof and arranged substantially parallel thereto, the sheathing members extending distally beyond the second side edges of the sheathing members, the sheathing leaf members being thereby adapted for insertion between sheathing members of another side-engaged building panel.

50. The building of claim 41, the plurality of building panels including at least one roof end panel:

a first panel side edge of the roof end panel comprising a male side edge or a female side edge;

a second panel side edge of the roof end panel comprising at least one finishing member;

the framing member of the roof end panel extending beyond the ends of the sheathing members, a first framing member end having a protruding tab, a second framing member end having a notch, the first and second ends of the framing member having side slots thereon adapted for receiving a retaining member;

the splines of the male panel side edge of the roof end panel each comprising a pair of substantially parallel first and second side members, the first and second side members being secured to the inner surfaces of the first and second sheathing members, respectively, in substantially opposing positions and extending distally from the side edges of the sheathing members;

the male panel side edge of the roof end panel further comprising a second elongated framing member positioned between the side members of the splines and secured thereto, the second framing member being arranged substantially parallel to the sheathing member side edges, a first end of the second framing member having a protruding tab, a second end of the second framing member having a notch;

the roof end panel having an intermediate framing member with a notch or a protruding tab at an end thereof for engaging an end of another building panel;

the female side edge of the roof end panel further comprising a plurality of elongated sheathing leaf members, the sheathing leaf members being secured between adjacent grooves to the inner surfaces of the sheathing members at the second side edges thereof and arranged substantially parallel thereto, the sheathing members extending distally beyond the second side edges of the sheathing members, the sheathing leaf members being thereby adapted for insertion between sheathing members of another side-engaged building panel.

51. The building of claim 41, further including at least one roof fascia element, the roof fascia element comprising:

an elongated trough-like member; and a plurality of fascia support members each positioned within and secured at a bottom end thereof to the trough-like member and extending out of the trough-like member, the support members each having at least one of a notch and a protruding tab at an upper end thereof, the trough-like member and support members being adapted for engaging framing members of roof panels, the trough-like member including at least one longitudinal slot adapted for receiving a retaining member.

52. The building of claim 41, further including at least one roof ridge element, the roof ridge element comprising:

an inner angled elongated facing member;

an outer elongated facing member; and a plurality of angled roof ridge support members positioned between and secured to the inner and outer facing members, each support member having at least one of a notch and a protruding tab at each end thereof, the angled support members being thereby adapted at both ends thereof for engaging framing members of roof panels along both sides of a roof, at least one of the facing members including at least one longitudinal slot adapted for receiving a retaining member.

53. The building of claim 41, further including at least one roof cap element, the roof cap element comprising:

an angled elongated facing member; and a plurality of roof cap support members secured to the facing member and each having at least one of a notch and a protruding tab at a lower end thereof, the support members being thereby adapted for engaging framing members of roof panels along one side of a roof.

54. The building of claim 41, further including at least one wall header element, the wall header element comprising:

a pair of substantially horizontal elongated facing members arranged in a substantially parallel spaced-apart arrangement; and a plurality of header support members positioned between and secured to the facing members, the each support member extending above and below the facing members, the support members each having a protruding tab at a first end thereof and a notch at a second end thereof, the support members being thereby adapted at both ends thereof for engaging framing members of building panels, at least one of the facing members including a longitudinal slot adapted for receiving a retaining member.

55. The building of claim 41, further including at least one wall/floor header element, the wall/floor header element comprising:

a pair of substantially horizontal elongated upper facing members arranged in a substantially parallel spaced-apart arrangement;

a pair of substantially horizontal elongated lower facing members arranged in a substantially parallel spaced-apart arrangement substantially parallel to and vertically spaced-apart from the upper facing members;

a plurality of header support members each positioned between and secured to the upper facing members and each positioned between and secured to the lower facing members, each support member extending above the upper facing members and below the lower facing members, the support members each having a protruding tab at a first end thereof and a notch at a second end thereof, the support members being thereby adapted for engaging framing members of building panels, the support members each having a side notch on each side thereof, the support members being thereby adapted for engaging framing members of building panels, at least one of the upper facing members including at least one longitudinal slot adapted for receiving a retaining member, at least one of the lower facing members including at least one longitudinal slot adapted for receiving a retaining member.

56. The building of claim 41, further including at least one sill element, the sill element comprising:

an elongated trough-like member; and a plurality of sill support members each positioned within and secured at a bottom end thereof to the trough-like member and extending out of the trough-like member, the support members each having at least one of a notch, a protruding tab, and a pair of lateral notches at an upper end thereof, the trough-like member and support members being adapted for engaging framing members of building panels, the trough-like member including at least one longitudinal slot adapted for receiving a retaining member.

* * * * *